US005153116A

United States Patent [19]

Metoki et al.

[11] Patent Number: 5,153,116

[45] Date of Patent: Oct. 6, 1992

[54] SILVER HALIDE PHOTOGRAPHIC LIGHT SENSITIVE MATERIAL EXCELLENT IN ANTISTATIC PROPERTY

[75] Inventors: Iku Metoki; Kiyoshi Sato, both of Hino, Japan

[73] Assignee: Konica Corporation, Tokyo, Japan

[21] Appl. No.: 660,248

[22] Filed: Feb. 22, 1991

Related U.S. Application Data

[63] Continuation of Ser. No. 428,854, Oct. 30, 1989, abandoned.

[30] Foreign Application Priority Data

Oct. 31, 1988 [JP] Japan ..... 63-276562
Nov. 14, 1988 [JP] Japan ..... 63-288366

[51] Int. Cl.[5] ..... G03C 1/005; G03C 1/08

[52] U.S. Cl. ..... 430/581; 430/569; 430/567; 430/584; 430/613; 430/614; 430/621; 430/631

[58] Field of Search ..... 430/569, 567, 584, 614, 430/631, 613, 621, 581

[56] References Cited

U.S. PATENT DOCUMENTS

| | | | |
|---|---|---|---|
| 2,870,015 | 1/1959 | Allen | 430/614 |
| 4,224,403 | 9/1980 | Toda et al. | 430/614 |
| 4,225,666 | 9/1980 | Locker et al. | 430/569 |
| 4,490,462 | 12/1984 | Kawaguchi et al. | 430/543 |
| 4,536,473 | 8/1985 | Mihara | 430/584 |
| 4,670,377 | 6/1987 | Miyoshi et al. | 430/621 |
| 4,791,053 | 12/1988 | Ogawa | 430/581 |
| 4,828,922 | 5/1989 | Ihama et al. | 430/569 |
| 4,847,191 | 7/1989 | Grzeskowiak | 430/584 |

FOREIGN PATENT DOCUMENTS

| | | |
|---|---|---|
| 90584 | 10/1983 | European Pat. Off. . |
| 287100 | 10/1988 | European Pat. Off. . |

*Primary Examiner*—Charles L. Bowers, Jr.
*Assistant Examiner*—Thorl Chea
*Attorney, Agent, or Firm*—Bierman and Muserlian

[57] ABSTRACT

There is disclosed a silver halide photographic light-sensitive material comprising a support and provided thereon, at least one silver halide light-sensitive layer spectrally sensitized by adding a spectral sensitizing dye during at least one process selected from a grain formation process, a physical reopening process and a desalting process, wherein said light-sensitive material contains at least one selected from the compounds represented by following Formula A:

wherein $R_1$ represents a hydrogen atom, an alkyl group, a cycloalkyl group, an alkenyl group, an aralkyl group, an alkoxy group, an aryl group, a heterocyclic group, a carbamoyl group, a thiocarbamoyl group, and a sulfamoyl group; $R_2$ and $R_3$ represent independently a hydrogen atom, a halogen atom, an alkyl group, a cycloalkyl group, an aryl group, a cyano group, an alkylthio group, an arylthio group, an alkylsulfoxide group, an alkylsulfonyl group, and a heterocyclic group, provided that $R_2$ and $R_3$ may combine each other to form a benzene ring.

28 Claims, No Drawings

SILVER HALIDE PHOTOGRAPHIC LIGHT SENSITIVE MATERIAL EXCELLENT IN ANTISTATIC PROPERTY

This application is a continuation of application number 07/428854, filed Oct. 30, 1989, now abandoned.

FIELD OF THE INVENTION

The present invention relates to a silver halide photographic light-sensitive material having an antistatic property, and more particularly to a silver halide photographic light-sensitive material improved in an antistatic property at a high humidity.

BACKGROUND OF THE INVENTION

In recent years, silver halide photographic light-sensitive materials (hereinafter referred to as "light-sensitive material") have been demanded to be improved in various aspects. What is especially required in the art is a light-sensitive material having a high sensitivity and stable photographic properties, and capable of producing images having good quality and less fogging.

In a light-sensitive material for X-ray, there is a strong demand for high sensitivity and high image quality so that a prescribed level of exposure can be attained with less amount of X-ray in order to minimize an exposure of X-ray to a human body, and for rapid processing in order to obtain the results of an X-ray examination as soon as possible.

Under such circumstances, various proposals including the methods of forming silver halide grains have heretofore been made to provide a light-sensitive material for X-ray photography having a higher sensitivity.

For instance, there is disclosed in Japanese Patent Publication Open to Public Inspection (hereinafter abbreviated as Japanese Patent O.P.I. Publication) Nos. 184142/1983, 19628/1986 and 205929/1986, a method in which a spectral sensitizer is added in the formation of silver halide grains, physical ripening or desalting.

Generally, a light-sensitive material comprising an insulated support and photographic component layers is liable to accumulate static electricity thereon due to friction caused by contact with the same or foreign materials. If accumulated static electricity is discharged before development, a light-sensitive material is exposed to form so-called static marks branch- and featherlike linear spots in development. These static marks impair significantly the commercial value of a light-sensitive material. Static marks appearing on an X-ray photograph for medical or industrial use are very dangerous since they tend to cause fatal misjudgement. The formation of such static marks cannot be found until development, which makes this phenomenon one of the serious problems. In addition, the accumulation of static electricity is liable to cause the secondary problem that it allows dust to adhere to the surface of a film and makes it difficult to carry out uniform coating. The formation of the static marks is expedited by a higher sensitivity, a higher coating speed, a higher Photographing speed and a rapid automatic processing. A light-sensitive material has to inevitably be brought into contact with various instruments such as a roller, or with another light-sensitive material during the production processes including coating, drying, processing and wrapping, or in loading a film, photographing and carrying out automatic development. Such contacts allow static electricity to generate.

In order to improve the conductivity of a support or photographic component layers, various methods have been proposed. These methods include the addition of various hydroscopic substances, water-soluble inorganic salts, a certain kind of a surface active agent, or a polymer.

However, these substances tend to show a specificity and adversely affect the photographic properties depending on a kind of support and photographic components. It is especially difficult to prevent the generation of static electricity in hydrophilic colloidal layers by the above substances. A surface specific resistance is not lowered sufficiently at a low temperature or a high humidity, and there is sometimes caused adhering between the light-sensitive materials themselves or to the other materials at a high temperature and a high humidity. There are many compounds such as polyethylene oxide compounds which have an antistatic effect, while they have adverse effects such as increased fogging, desensitization, deteriorated graininess. It is difficult to find out an antistatic agent which is suited to a light-sensitive material for an X-ray photograph for medical use, which has an emulsion layer on each side of a support.

In the case of the above-mentioned light-sensitive material for X-ray photograph highly sensitized by a spectral sensitizer, there has been found the unexpected problem that the surface specific resistance is increased significantly at a high humidity (humidity: 50% or more).

The conventional antistatic methods have been found to have an effect to some extent, but they are not necessarily satisfactory since they sometimes impair other properties such as sensitization.

SUMMARY OF THE INVENTION

The primary object of the present invention is to provide a high sensitive silver halide photographic light-sensitive material which is imparted with an antistatic property by an antistatic agent having no any adverse effects on the photographic properties.

The secondary object of the present invention is to provide a highly sensitized light-sensitive material for X-ray photograph which has an improved surface specific resistance at a high humidity.

The above objects can be attained by a silver halide photographic light-sensitive material having a support and provided thereon, at least one silver halide emulsion layer spectrally sensitized by the addition of a spectral sensitizer during at least one process of grain formation, physical ripening and desalting, characterized by that the light-sensitive material contains at least one selected from the compounds represented by following Formula A:

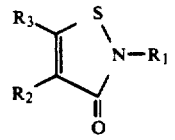

wherein $R_1$ represents a hydrogen atom, an alkyl group, a cycloalkyl group, an alkenyl group, an aralkyl group, an alkoxy group, an aryl group, a heterocyclic group, a carbamoyl group, a thiocarbamoyl group, and a sulfamoyl group; $R_2$ and $R_3$ each represent a hydrogen atom, a halogen atom, an alkyl group, a cycloalkyl group, an aryl group, a cyano group, an alkylthio group, an arylthio group, an alkylsufoxide group, an alkylsulfonyl group and a heterocyclic group, provided that $R_2$ and $R_3$ may combine each other to form a benzene ring; provided that said alkyl group, cycloalkyl group, alkenyl group, alkoxy group, carbamoyl group, thiocarbamoyl group, sulfamoyl group, heterocyclic group, aralkyl group and aryl group may have substituents.

DETAILED DESCRIPTION OF THE INVENTION

The compound represented by Formula A is represented by Formula A-1, unless $R_2$ and $R_3$ combine each other to form a benzene ring, and by Formula A-2, provided that they combine to form the benzene ring:

Formula A-1

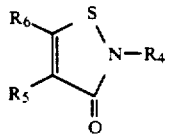

Formula A-2

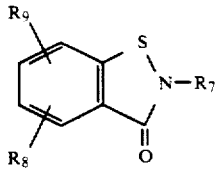

In Formula A-1, $R_4$, $R_5$ and $R_6$ represent the same groups as those defined by $R_1$, $R_2$ and $R_3$ in Formula A, respectively.

The alkyl group and alkenyl group represented by $R_4$ each have 1 to 36, preferably 1 to 18 carbon atoms, wherein the alkyl group may have a substituent including a halogen atom, a hydroxy group, an amino group and an alkylamino group. The cycloalkyl group represented by $R_4$ has 3 to 12, preferably 3 to 6 carbon atoms. The aryl group includes a phenyl group which may have a substituent including a halogen atom, a nitro group and a cyano group. The carbamoyl, thiocarbamoyl and sulfamoyl groups represented by $R_4$ each may have a substituent including an alkyl group having 1 to 8 carbon atoms and a phenyl group which may have substituents such as a halogen atom, a nitro group and a cyano group.

The heterocyclic ring represented by $R_4$ is a 5- or 6-membered heterocylic ring containing at least one hetero atom selected from N, O and S, including a furyl group, a thiazolyl group and a thienyl group, each of which may have a substituent such as an alkyl group having 1 to 5 carbon atoms, and a halogen atom.

The examples of the compound represented by Formula A-1 are shown below.

| Compound No. | $R_4$ | $R_5$ | $R_6$ |
|---|---|---|---|
| 1 | $CONHCH_3$ | H | H |
| 2 | " | " | $CH_3$ |
| 3 | $CSNHCH_3$ | " | H |
| 4 | $CONHCH_3$ | Br | $CH_3$ |
| 5 | " | CN | $SCH_3$ |
| 6 | " | " | $SO_2CH_3$ |
| 7 | " | " | $SC_2CH_3$ |
| 8 | $CONHC_4H_9$ | H | H |
| 9 | $CONHC_8H_{17}(t)$ | " | " |

-continued

| Compound No. | $R_4$ | $R_5$ | $R_6$ |
|---|---|---|---|
| 10 | 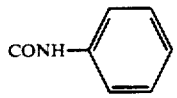 | " | $CH_3$ |
| 11 | " | CN | $SCH_3$ |
| 12 | 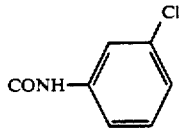 | Br | $CH_3$ |
| 13 | " | H | $CH_2Br$ |
| 14 | " | " | $CH_3$ |
| 15 | " | CN | $SCH_3$ |
| 16 | 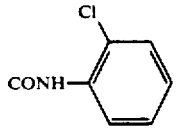 | H | $CH_3$ |
| 17 | " | " | $CH_2Br$ |
| 18 | 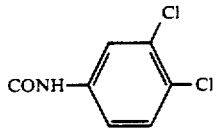 | Br | $CH_3$ |
| 19 | " | H | " |
| 20 | " | CN | $SCH_3$ |
| 21 | 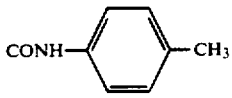 | H | $CH_3$ |
| 22 | 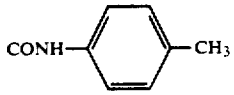 | CN | $SCH_3$ |
| 23 | " | Br | $CH_3$ |
| 24 | $CONHC_3H_7$ | H | H |
| 25 | $CONHC_2H_5$ | " | " |
| 26 | $CONHC_3H_7(i)$ | " | " |
| 27 | $CONHCH_3$ | Br | " |
| 28 | 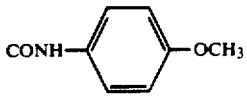 | H | " |
| 29 | 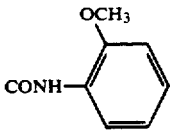 | " | " |
| 30 | 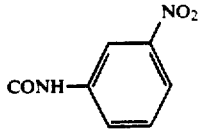 | " | " |

-continued

| Compound No. | $R_4$ | $R_5$ | $R_6$ |
|---|---|---|---|
| 31 | 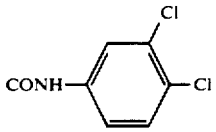 | H | H |
| 32 | $CONHC_{10}H_{21}$ | " | " |
| 33 | 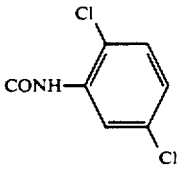 | " | " |
| 34 | $CONHCH_2COOC_2H_5$ | " | " |
| 35 | 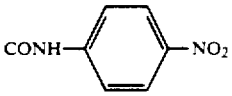 | " | " |
| 36 | $CONHC_2H_5$ | " | $CH_3$ |
| 37 | $CSNHC_2H_5$ | " | " |
| 38 | $CONHC_2H_5$ | H | Cl |
| 39 | $C_3H_7$ | " | H |
| 40 | $C_4H_9(t)$ | " | " |
| 41 | $C_4H_9$ | " | " |
| 42 | 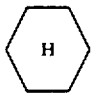 | " | " |
| 43 | $C_8H_{17}(t)$ | " | " |
| 44 | 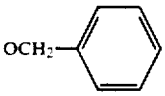 | " | " |
| 45 | $CH_3$ | " | Cl |
| 46 | 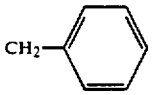 | " | " |
| 47 | $CH_3$ | Cl | " |
| 48 | " | $CH_3$ | H |
| 49 | 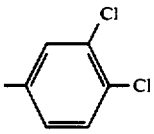 | " | " |
| 50 | " | H | " |
| 51 | 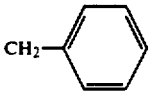 | Cl | Cl |
| 52 | $CH_3$ | Br | " |
| 53 | " | Br | H |
| 54 | $CH_2OH$ | H | " |
| 55 | $CH_2CH_2N(C_2H_5)_2$ | " | " |
| 56 | $C_3H_7$ | " | "* |

-continued

| Compound No. | $R_4$ | $R_5$ | $R_6$ |
|---|---|---|---|
| 57 | $CH_3$ | " | Cl* |
| 58 | $C_2H_5$ | " | H* |
| 59 | $CH_3$ | " | "* |
| 60 | 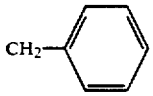 | H | H* |
| 61 | $C_{12}H_{25}$ | " | " |
| 62 | $C_{14}H_{29}$ | " | " |
| 63 | 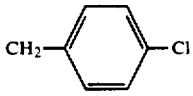 | " | " |
| 64 | 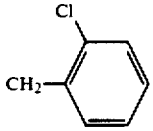 | " | " |
| 65 | 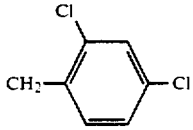 | " | " |
| 66 | 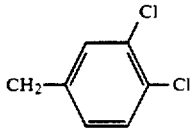 | " | " |
| 67 | 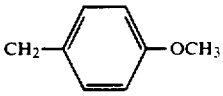 | " | " |
| 68 | 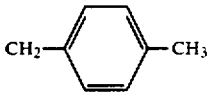 | " | " |
| 69 | $CH_2CHC_4H_9$ \| $OC_2H_5$ | " | " |
| 70 | 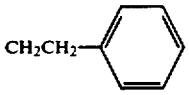 | " | " |
| 71 | " | Cl | " |
| 72 | 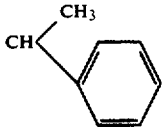 | H | " |
| 73 | $C_{10}H_{21}$ | H | H |
| 74 | $C_8H_{17}$ | " | " |
| 75 | $C_8H_{17}(t)$ | Cl | " |
| 76 | " | Br | " |
| 77 | $C_9H_{19}$ | H | " |
| 78 | $C_8H_{17}$ | " | Cl |

-continued

| Compound No. | $R_4$ | $R_5$ | $R_6$ |
|---|---|---|---|
| 79 | 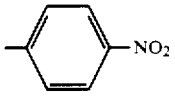 | " | H |
| 80 | 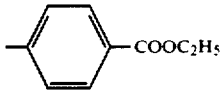 | " | " |
| 81 | $CH_3$ | " | Cl** |
| 82 | " | Cl | "** |
| 83 | $C_2H_5$ | H | H** |
| 84 | $C_3H_7$ | " | "** |
| 85 | 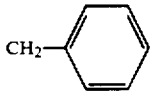 | " | "** |
| 86 | $CONH_2$ | Cl | H |
| 87 | " | H | Cl |
| 88 | $NHSO_2CH_3$ | " | H |
| 89 | 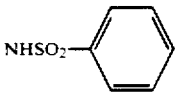 | " | " |
| 90 | 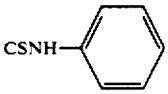 | " | " |
| 91 | $CSNH_2$ | " | " |
| 92 | $CH_3$ | 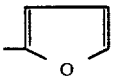 | " |
| 93 | " | $-OSO_2CH_3$ | " |
| 94 | $CONHCH_3$ | 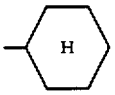 | " |
| 95 | " | 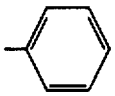 | " |
| 96 | 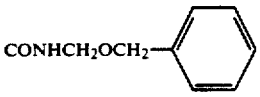 | $CH_3$ | " |

*HCl salt
**$ClCH_2CO_2H$ salt

In Formula A-2, $R_7$ represents the same groups as those defined by $R_1$ in Formula A including a hydrogen atom; an alkyl group having 1 to 4 carbon atoms such as methyl, ethyl, propyl and butyl; an alkoxy group having 1 to 4 carbon atoms such as methoxy, ethoxy, propoxy and butoxy; and a hetero-cyclic group. The heterocyclic group represented by $R_7$ includes the same groups as those defined by $R_4$ in Formula A-1. $R_8$ and $R_9$ each represent a hydrogen atom, a halogen atom, an alkyl group having 1 to 4 carbon atoms, an alkoxy group having 1 to 4 carbon atoms a nitro group, and a cyano group.

The examples of the compound represented by Formula A-2 are shown below.

Formula A-2

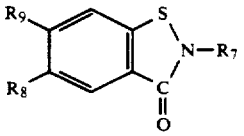

| Compound No. | $R_7$ | $R_8$ | $R_9$ |
|---|---|---|---|
| 97 | H | H | H |
| 98 | $CH_3$ | " | " |
| 99 | $C_2H_5$ | " | " |
| 100 | $C_3H_7$ | " | " |
| 101 | $C_4H_9$ | " | " |
| 102 | (s)$C_4H_9$ | " | " |
| 103 | (t)$C_4H_9$ | " | " |
| 104 | $OCH_3$ | " | " |
| 105 | $OC_2H_5$ | " | " |
| 106 | $OC_3H_7$ | " | " |
| 107 | $OC_4H_9$ | " | " |
| 108 | H | Cl | " |
| 109 | " | $CH_3$ | " |
| 110 | " | H | $CH_3$ |
| 111 | " | CN | H |
| 112 | " | H | $OC_2H_5$ |
| 113 | " | $NO_2$ | H |
| 114 | " | $OCH_3$ | " |
| 115 | 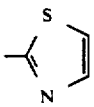 | H | " |
| 116 | 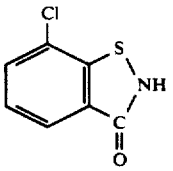 | | |

These compounds may be added to a hydrophilic colloid or coated on a protective layer in the form of solution obtained by dissolving the compounds in water or an organic solvent such as alcohols (e.g. methanol, ethanol, isopropanol), glycols (e.g. ethylene glycol, propylene glycol) and esters (e.g. ethyl acetate), which will not badly affect the photographic properties. It is also possible to dip a light-sensitive material in such solution. These compounds may be added to a solution containing hydrophilic colloid in the presence of a surfactant or coated on a protective layer in the form of solution obtained by dissolving the compounds in a high boiling solvent, a low boiling solvent or a mixture thereof. The compounds dispersed in a polymer such as polybutylacrylate in the presence of a surface active agent may be added to a solution containing hydrophilic colloid or coated on a protective layer.

An isothiazoline-3-one compound represented by Formula A-1 is added preferably in an amount of $1\times10^{-4}$ to 10% by weight, more preferably $3\times10^{-4}$ to 1% by weight of a hydrophlic colloid.

A 1,2-benzisothiazoline-3-one compound represented by Formula A-2 is added preferably in an amount of $1\times10^{-4}$ to 10% by weight, more preferably $1\times10^{-4}$ to 1% by weight of a hydrophilic colloid.

The compound represented by Formula A can be synthesized readily according to a method described in French Patent No. 1555416 or a method similar thereto.

In the present invention, methyne dyes are generally used as a spectral sensitizing dye. The examples of methyne dyes include cyanine dyes, merocyanine dyes, complex cyanine dyes, complex merocyanine dyes, holopolarcyanine dyes, hemicyanine dyes, styryl dyes and hemioxanol dyes.

Of the above-described dyes, especially useful are cyanine dyes. The cyanine dyes useful for the present invention are represented by following Formula I:

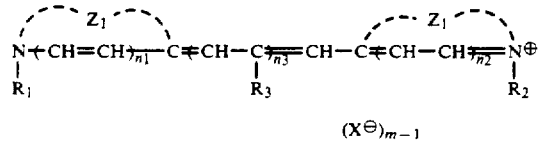

wherein $Z_1$ and $Z_2$ each represent the group of non-metallic atoms necessary to form a pyrroline ring, a thiazoline ring, a thiazole ring, a benzothiazole ring, a naphthothiazole ring, a selenazole ring, a benzoselenazole ring, a naphthoselenazole ring, an oxazole ring, a benzoxazole ring, a naphthoxazole ring, an imidazole ring, a benzimidazole ring, a pyridine ring, each of which may have a substituent of a halogen atom, a lower alkyl group, a lower alkoxy group and a phenyl group or a phenyl group condensed thereto; $R_1$ and $R_2$ each represent a lower alkyl group, a hydroxyalkyl group, a carboxyalkyl group and a sulfoalkyl group; $R_3$ represents a lower alkyl group or a hydrogen atom when $n_3$ is 1, and a hydrogen atom when $n_3$ is 2; $n_1$ and $n_2$ each represent 0 and 1; $n_3$ represents for 0, 1, or 2; $X^{\ominus}$ represents an anion; and m represents 1 or 2.

The benzothiazole ring formed by $Z_1$ or $Z_2$ in Formula I includes benzothiazole, 5-chlorobenzothiazole, 5-methylbenzothiazole, 5-methoxybenzothiazole, 5-hydroxybenzothiazole, 5-hydroxy-6-methylbenzothiazole, 5,6-dimethylbenzothiazole, 5-ethoxy-6-methylbenzothiazole, 5-phenylbenzothiazole, 5-carboxybenzothiazole, 5-ethoxycarbonylbenzothiazole, 5,6-dimethylaminobenzothiazole, and 5-acetylaminobenzothiazole. The benzoselenazole ring includes benzoselenazole, 5-chlorobenzoselenazole, 5-methylbenzoselenazole, 5-methoxybenzoselenazole, 5-hydroxybenzoselenazole, 5,6-dimethylbenzoselenazole, 5,6-dimethoxybenzoselenazole, 5-ethoxy-6-methylbenzoselenazole, 5-hydroxy-6-methylbenzoselenazole and 5-phenylbenzoselenazole. The naphthothiazole ring includes β-naphthothiazole and β,β-naphthothiazole. The naphthoselenazole ring includes β-naphthoselenzole. The benzoxazole ring includes benzoxazole, 5-chloro-benzoxazole, 5-phenylbenzoxazole, 6-methoxybenzoxazole, 5-methyl-benzoxazole and β,β-naphthoxazole. The benzimidazole ring includes benzimidazole, 5-chloro-benzimidazole, 5,6-dichlorobenzimidazole, 5-methoxycarbonylbenzimidazole, 5-ethoxycarbonylbenzimidazole, 5-buthoxycarbonylbenzimidazole and 5-fluoro-benzimidazole.

The groups represented by $R_1$ and $R_2$ include an alkyl group such as a methyl group, an ethyl group, a n-propyl group, and a substituted alkyl group such as a β-carboxyethyl group, a γ-carboxypropyl group, a -sulfopropyl group, a γ-sulfobutyl group, a -sulfobutyl group and a sulfoethoxyethyl group. The group represented by $R_3$ includes a hydrogen atom, a methyl group, an ethyl group and a propyl group. The anion represented by X includes a halogen ion, a perchloric acid ion, a thiocyanic acid ion, a benzenesulfonic acid ion, a p-toluenesulfonic acid ion and a methylsulfuric acid ion.

In the present invention, a sensitizer represented by following Formula II is also used:

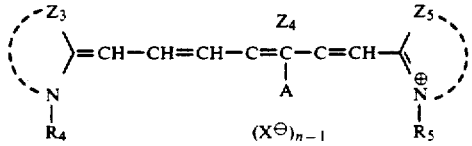

wherein $Z_3$ and $Z_5$ each represent the group of non-metallic atoms necessary to form a benzothiazole ring, a benzoxazole ring, a naphthothiazole ring and a naphthoxazole ring, each of which may have a substituent; $R_4$ and $R_5$ each represent a saturated or unsaturated aliphatic group; $Z_4$ represents a 5- or 6-membered hydrocarbon ring; and A represents a hydrogen atom when $Z_4$ forms a 6-membered ring. The sensitizer represented by Formula II is represented by following Formula II-a when the ring formed by $Z_4$ is a 5-membered ring:

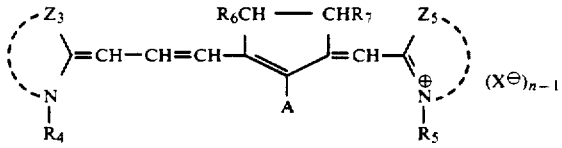

wherein A represents

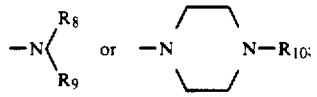

$R_6$ and $R_7$ each represent a hydrogen atom, an alkyl group having 1 to 4 carbon atoms, a halogen atom or an alkoxy group having 1 to 4 carbon atoms; $R_8$ and $R_9$ each represent an alkyl group having 1 to 12 carbon atoms, an alkoxycarbonylalkyl group, and a substituted or unsubstituted aryl group; and $R_{10}$ represents an alkyl group having 1 to 12 carbon atoms, an aryl group having 6 to 10 carbon atoms, or an alkoxycarbonyl group having an alkoxy group having 1 to 4 carbon atoms; $X^{\ominus}$ represents an anion; and n is 1 or 2.

The sensitizer represented by Formula II is represented by following Formula II-b when the ring formed by $Z_4$ is a 6-membered ring:

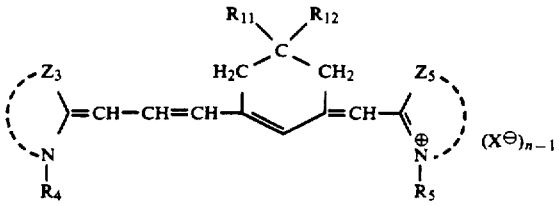

wherein $R_{11}$ represents a hydrogen atom or a methyl group; $R_{12}$ represents a hydrogen atom, an alkyl group having 1 to 4 carbon atoms or a monocyclic aryl group; $X^{\ominus}$ represents an anion; and n represents 1 or 2, provided that when an inner salt is formed, n is 1.

The substituents for the rings formed by $Z_3$ and $Z_5$ in Formula II include a halogen atom, an alkyl group having 1 to 4 carbon atoms, and an alkoxy group having 1 to 4 carbon atoms.

The saturated or unsaturated aliphatic groups represented by $R_4$ and $R_5$ include a methyl group, an ethyl group, a 2-hydroxyethyl group, a 2-methoxyethyl group, a 2-acetoxyethyl group, a carboxymethyl group, a 2-carboxyethyl group, a 3-carboxypropyl group, a 4-carboxybutyl group, a 2-sulfoethyl group, a 3-sulfopropyl group, a 3-sulfobutyl group, a 4-sulfobutyl group, a vinylmethyl group, a benzyl group, a phenetyl group, a p-sulfophenetyl group, an n-propyl group, an isopropyl group and a n-butyl group.

The examples of the compound represented by Formula I are shown below:

I-1

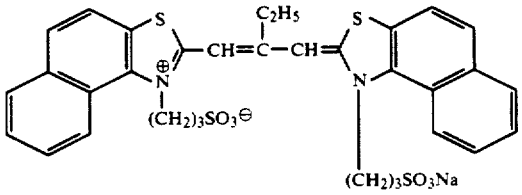

I-2

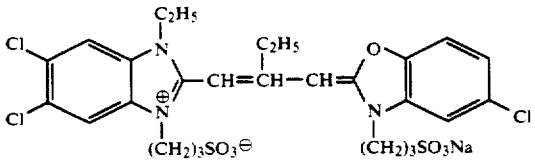

I-3

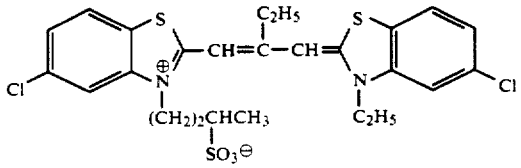

I-4

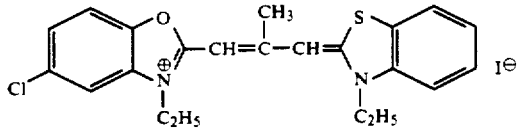

I-5

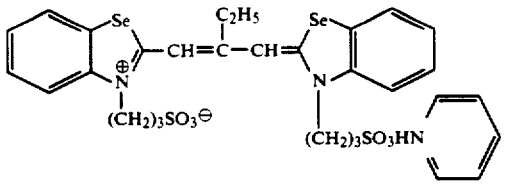

I-6

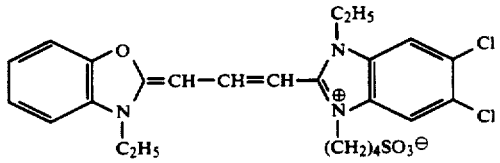

I-7

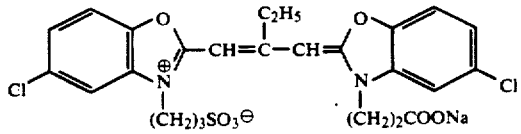

-continued
I-8
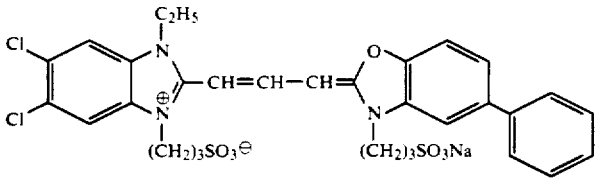
I-9
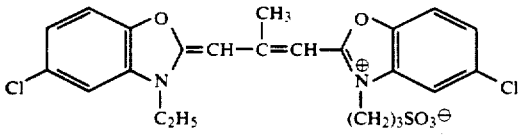
I-10
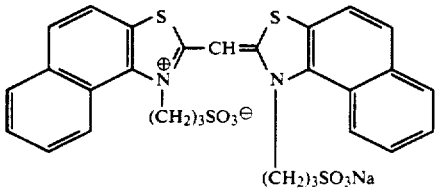
I-11
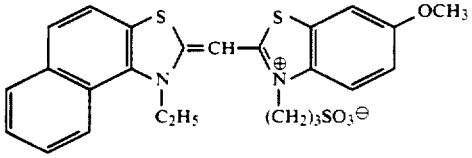
I-12
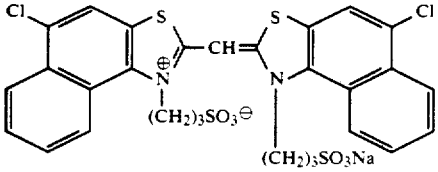
I-13
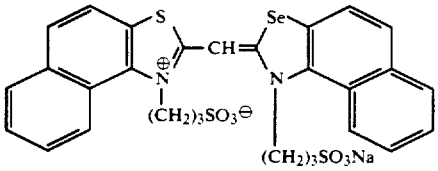
I-14
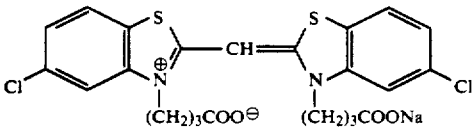
I-15
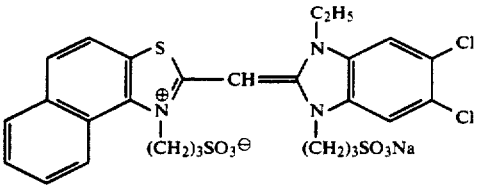
I-16
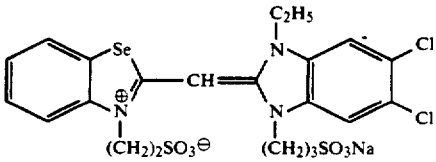

-continued
I-17
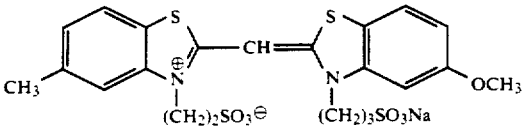
I-18
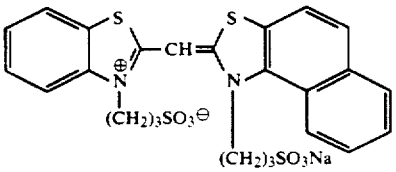
I-19
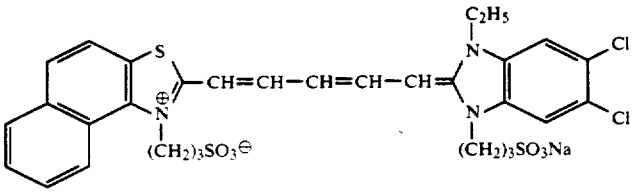
I-20
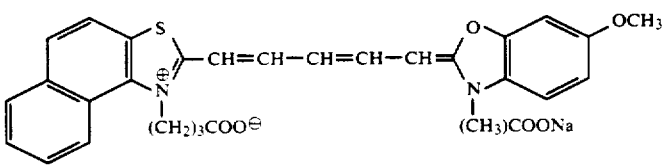
I-21
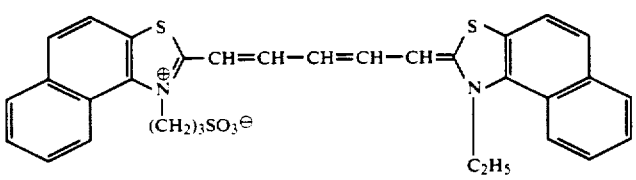
I-22
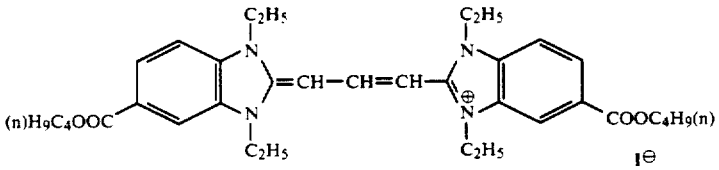
I-23
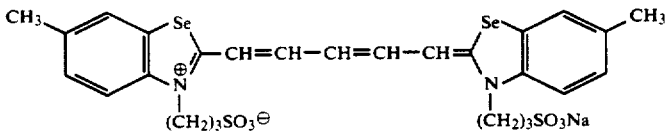
I-24
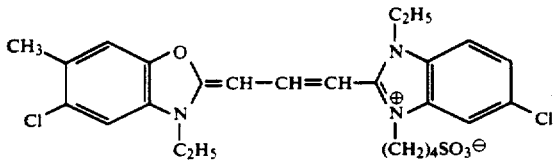
I-25
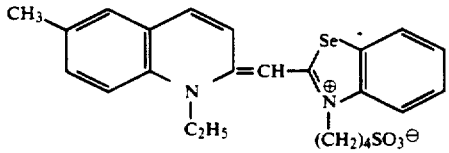

-continued
I-26
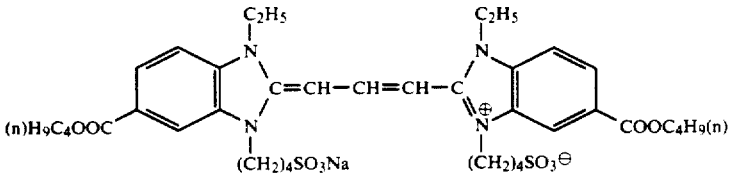
I-27
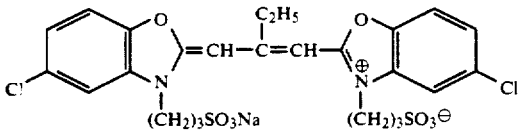
The examples of the compound represented by Formula II are shown below:
II-1
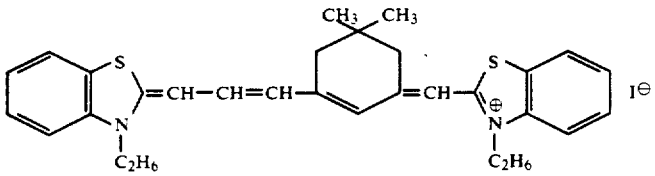
II-2
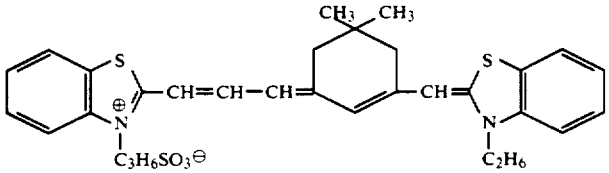
II-3
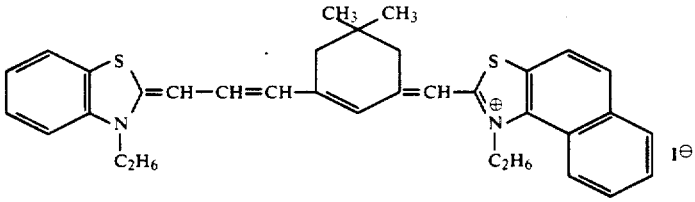
II-4
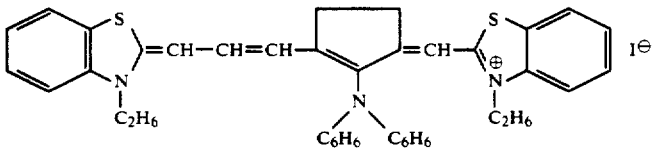
II-5
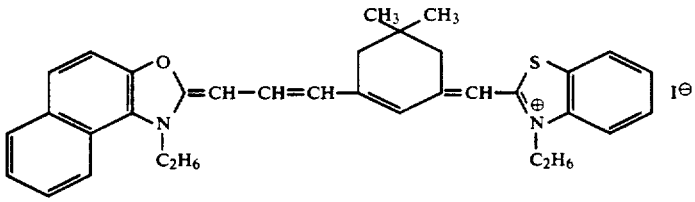
II-6
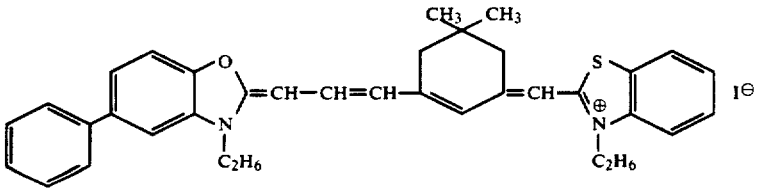

-continued
II-7
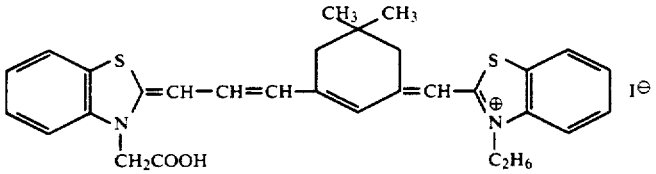
II-8
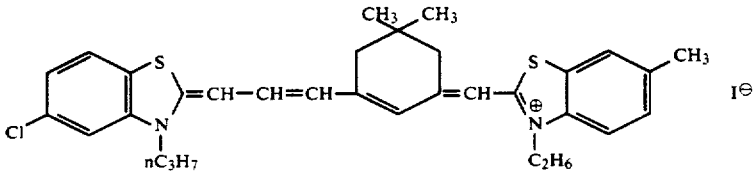
II-9
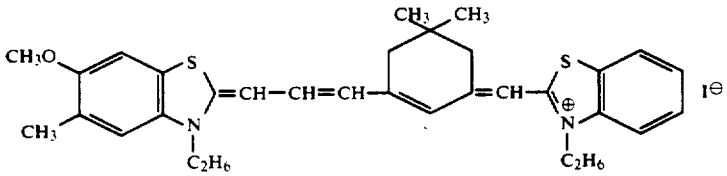
II-10
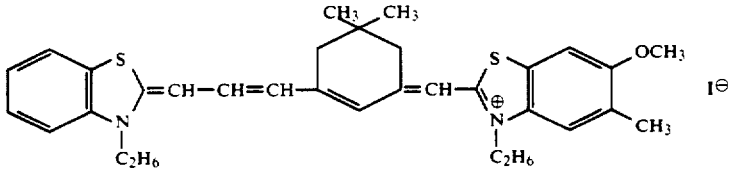
II-11
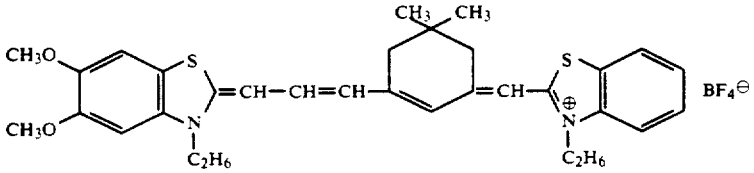
II-12
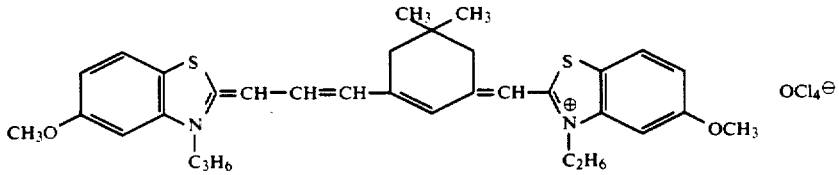
II-13
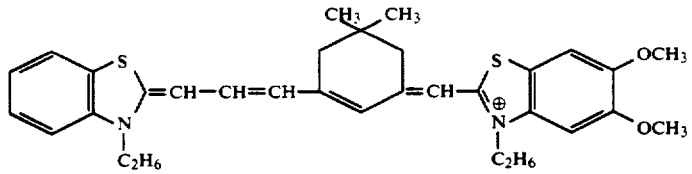
II-14
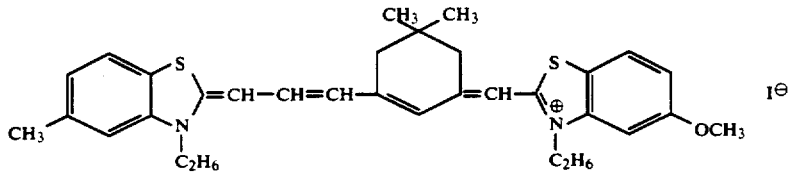
II-15
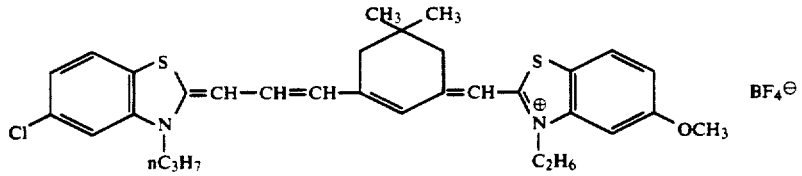

-continued
II-16
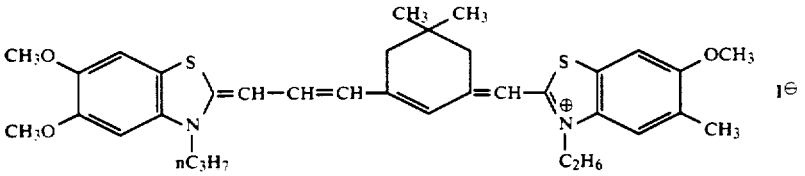
II-17
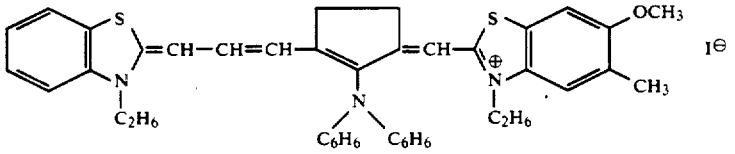
II-18
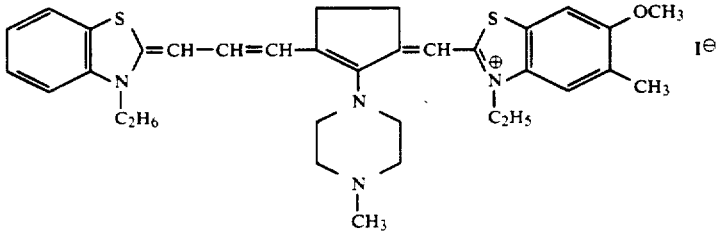
II-19
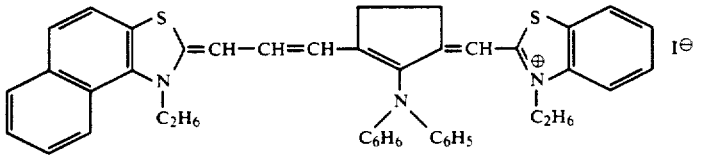
II-20
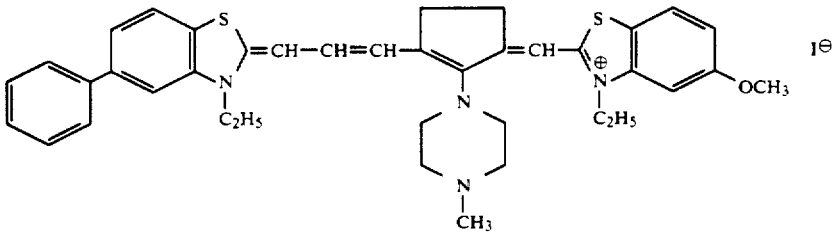
II-21
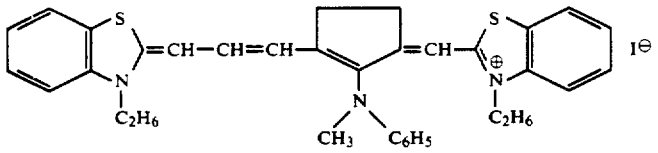
II-22
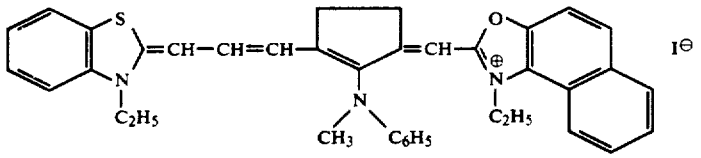
II-23
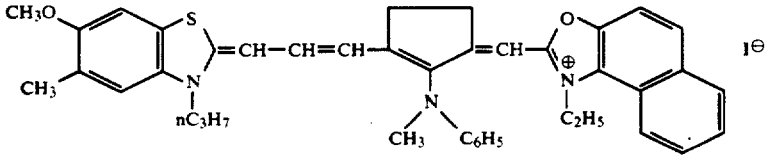

-continued
II-24
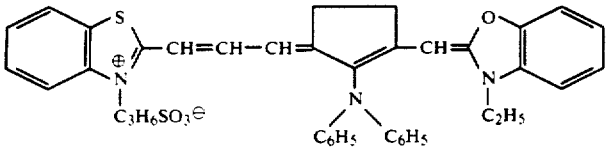
II-25
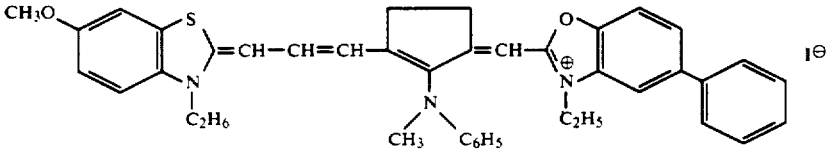
II-26
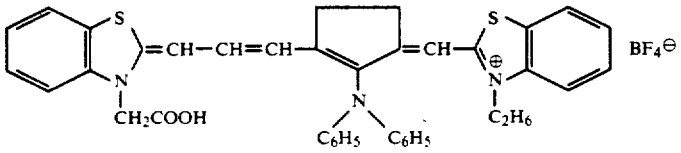
II-27
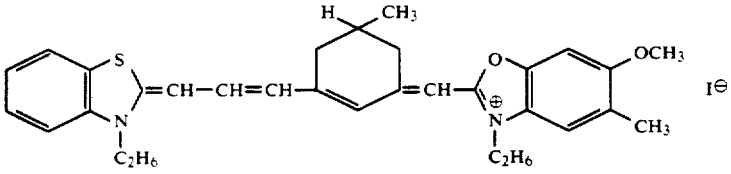
II-28
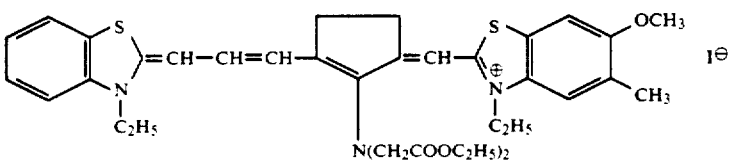
II-29
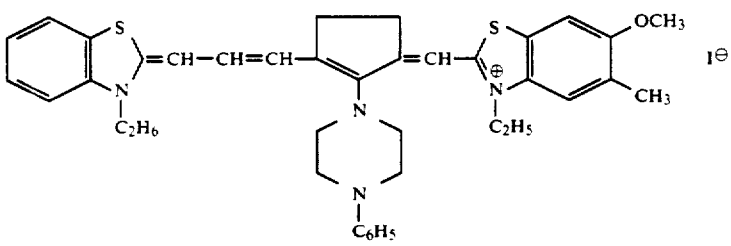
II-30
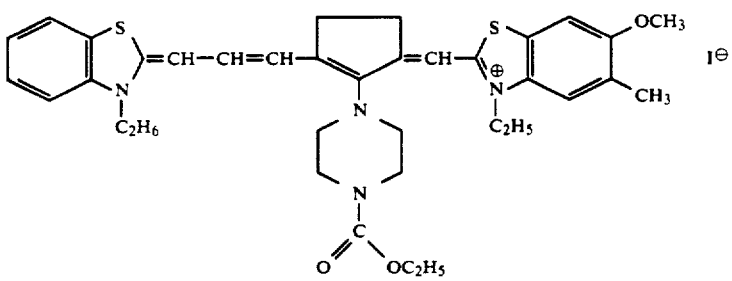
II-31
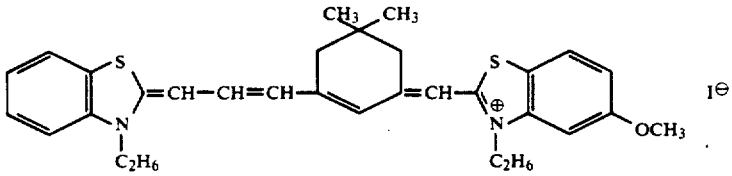

-continued

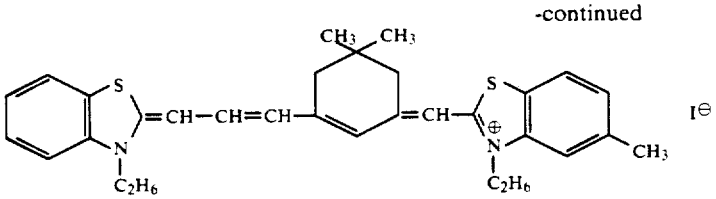

II-32

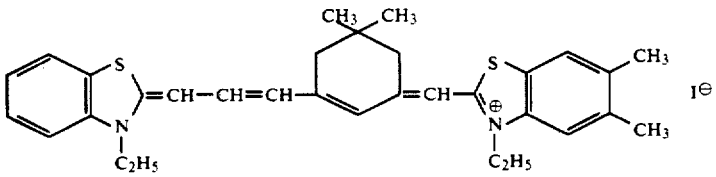

II-33

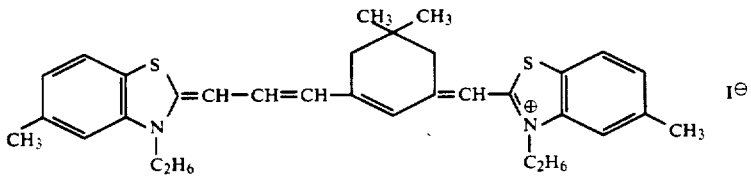

II-34

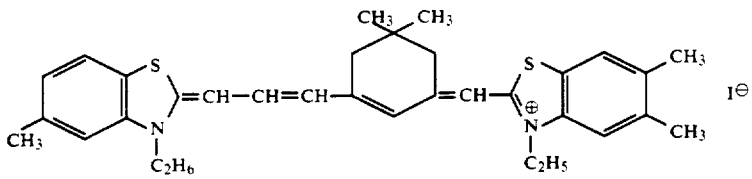

II-35

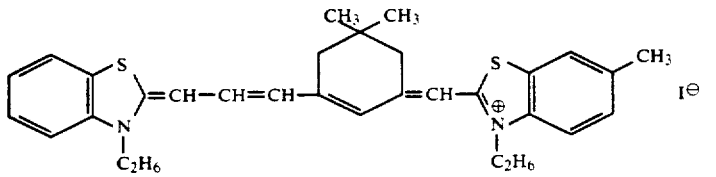

II-36

The above-described sensitizing dyes include the cyanine dyes described in F. M. Hamer: "Heterocyclic Compounds Cyanine Dyes and Related Compounds", John Wily & Sons (New York, London) published in 1964. The methods of preparing these cyanine dyes are also described in this book.

These sensitizing dyes are singly or in combination added to a silver halide emulsion during a prescribed process in order to obtain a desired spectral sensitivity.

The processes of grain formation, physical ripening and desalting in the invention mean the course from the completion of a reaction between a silver salt solution and a halide solution in preparing silver halide grains until the removal of water solution salts through physical ripening.

The sensitizing dye may be added in any process as long as it is any of the above-mentioned processes.

The method of desalting includes the flocculation method and the noodle washing method described in Research Disclosure No. 17643.

These sensitizing dyes are added preferably in an amount of 0.01 to 10 millimol, more preferably 0.1 to 1 millimol, per mol of a silver halide.

In the present invention, a vinylsulfone type hardener is added preferably to a hydrophilic colloid layer in order to achieve the effects of the invention.

The vinylsulfone type hardener used herein means the compound containing a vinyl group combined to a sulfonyl group or a group capable of forming a vinyl group, and containing preferably at least two vinyl groups combined to a sulfonyl group or at least two groups capable of forming a vinyl group. The hardeners useful in the invention are represented by following Formula VS-I:

$$L-(SO_2-X)m$$

wherein L represents an m-valent linkage group; X represents $-CH=CH_2$ or $-CH_2CH_2Y$; Y represents a group capable of splitting off in the form of HY by reaction with a base, such as a halogen atom, a sulfonyloxy group, a sulfoxy group and a salt thereof, a residue of a tertiary amine; and m represents an integer of 2 to 10, provided that a plural of $-SO_2-X$ may be identical or different when m is 2 or more.

The m-valent linkage group represented by L is an m-valent group formed by combining one or more of an aliphatic hydrocarbon group (e.g. an alkylene group, an alkylidene group, an alkylidine group, and a group formed in combination thereof), an aromatic hydrocarbon group (e.g. an arylene group and a group formed in combination thereof), —O—, $-NR^1-$ wherein $R^1$ represents a hydrogen atom or an alkyl group having 1 to 15 carbon atoms, —S—, —N—, —CO—, —SO—, $-SO_2-$, and $-SO_3-$, provided that $R^1$,s may combine each other to form a ring when said group contains two or more $-NR^1-$. The linkage group represented by L may have a substituent such as a hydroxy group, an alkoxy group, a carbamoyl group, a sulfamoyl group, an alkyl group, and an aryl group. X is preferably $-CH=CH_2$ or $-CH_2CH_2Cl$.

The examples of the vinylsulfone type hardener are shown below:

$H_2C=CHSO_2CH_2SO_2CH=CH_2$ V-1

$H_2C=CHSO_2(CH_2)_2SO_2CH=CH_2$ V-2

$H_2C=CHSO_2(CH_2)_3SO_2CH=CH_2$ V-3

$H_2C=CHSO_2CH_2OCH_2SO_2CH=CH_2$ V-4

$H_2C=CHSO_2(CH_2)_2O(CH_2)_2SO_2CH=CH_2$ V-5

$H_2C=CHSO_2CH_2\underset{\underset{OH}{|}}{C}HCH_2SO_2CH=CH_2$ V-6

$H_2C=CHSO_2CH_2\underset{\underset{OH}{|}}{C}HCH_2\underset{\underset{OH}{|}}{C}HCH_2SO_2CH=CH_2$ V-7

$H_2C=CHSO_2CH_2CONHCH_2NHCOCH_2SO_2CH=CH_2$ V-8

$H_2C=CHSO_2CH_2CONH(CH_2)_2NHCOCH_2SO_2CH=CH_2$ V-9

$H_2C=CHSO_2CH_2CONHCH_2CH_2NHCOCH_2SO_2CH=CH_2$ V-10

V-11

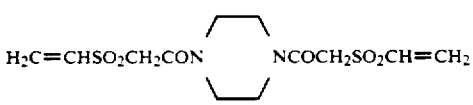

V-12

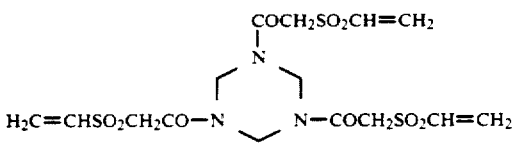

V-13

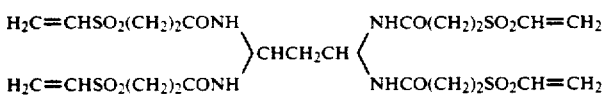

V-14

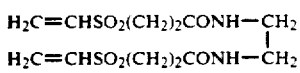

V-15

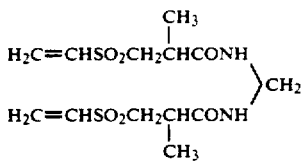

V-16

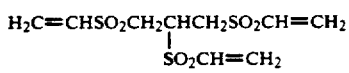

V-17

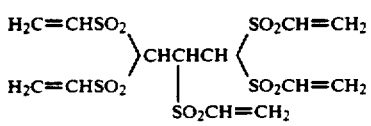

V-18

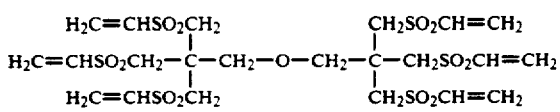

-continued
V-19
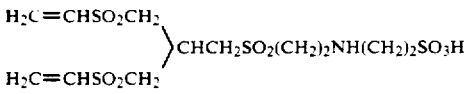
$[(H_2C{=}CHSO_2)_3CCH_2SO_2(CH_2)_2SCH_2]_2CO$ V-20
V-21
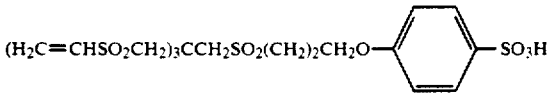
$(H_2C{=}CHSO_2CH_2)_4C$ V-22
V-23
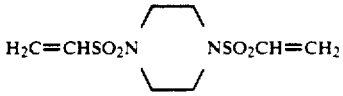
$(H_2C{=}CHSO_2CH_2)_3CC_2H_5$ V-24
V-25
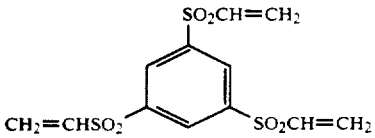
V-26
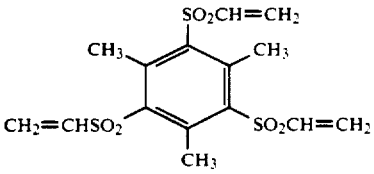
V-27
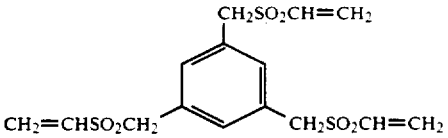
V-28
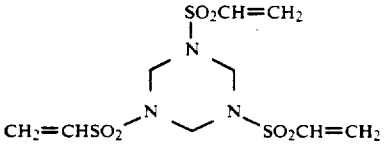
V-29
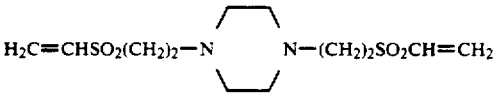
$H_2C{=}CHSO_2(CH_2)_2SO_2(CH_2)_2SO_2CH{=}CH_2$ V-30
$H_2C{=}CHSO_2(CH_2)_2O(CH_2)_2NHONH(CH_2)_2O(CH_2)_2SO_2CH{=}CH_2$ V-31
V-32
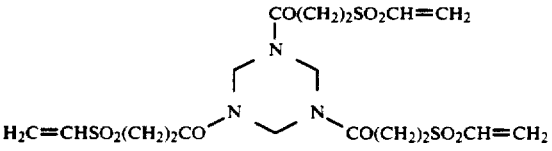
V-33
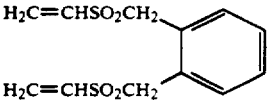

-continued

V-34

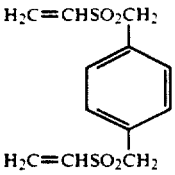

$(H_2C{=}CHSO_2NH)_2CH_2$ V-35

$H_2C{=}CHSO_2(CH_2)_2NH(CH_2)_2NH(CH_2)_2SO_2CH{=}CH_2$ V-36

$(H_2C{=}CHSO_2(CH_2)_2CO\underset{\underset{CH_3}{|}}{N}CH_2)_2CH_2$ V-37

$Cl(CH_2)_2SO_2\underset{\underset{C_2H_5}{|}}{C}HCOO(CH_2)_2OCO\underset{\underset{C_2H_5}{|}}{C}HSO_2(CH_2)_2Cl$ V-38

V-39

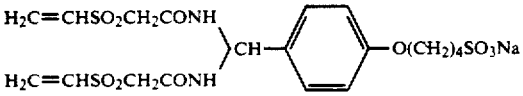

V-40

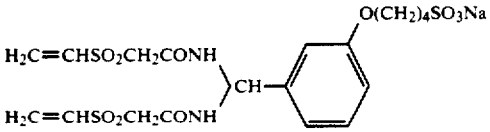

$C_8H_{17}C(CH_2SO_2CH{=}CH_2)_3$ V-41

V-42

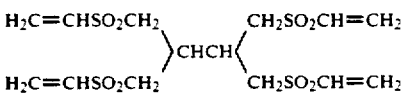

V-43

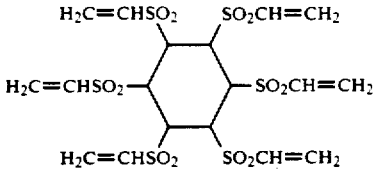

$CH_2(CONHCH_2SO_2CH{=}CH_2)_2$ V-44

V-45

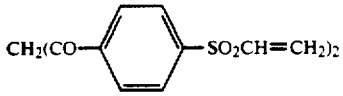

$C[CO(CH_2)_2SO_2CH{=}CH_2]_4$ V-46

V-47

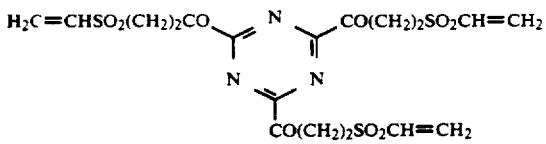

$NH[(CH_2)_2SO_2CH{=}CH_2]_2$ V-48

$CH_3C(CH_2OCH_2SO_2CH{=}CH_2)_3$ V-49

$C(CH_2OCH_2SO_2CH{=}CH_2)_4$ V-50

$N[(CH_2)_2OCH_2SO_2CH{=}CH_2]_3$ V-51

$(CH_2{=}CHSO_2CH_2)_3CCHSO_2(CH_2)_2Cl$ V-52

$H_2C{=}CHSO_2CH{=}CH_2$ V-53

$H_2C{=}CHSO_2CH_2C(CH_2SO_2CH_2CH_2OSO_3^{\ominus}Na^{\oplus})_3$ V-54

-continued $CH_3SO_3(CH_2)_2SO_2(CH_2)_2OSO_2CH_3$ V-55

V-56

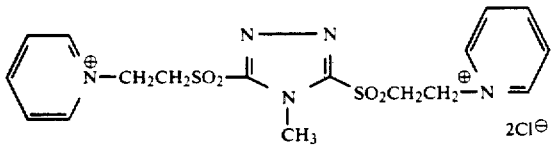

V-57

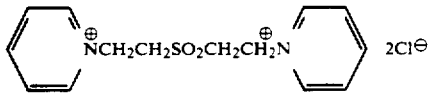

The vinylsulfone type hardener used in the present invention include the aromatic compounds described in German Patent No. 1,100,942 and U.S. Pat. No. 3,490,911; the alkyl compounds combined by hetero atoms described in Japanese Patent Examined Publication Nos. 29622/1969, 25373/1972 and 24259/1972; the sulfonamide and ester compounds described in Japanese Patent Examined Publication No. 8736/1972; 1,3,5-tris[β-(vinylsulfonyl)-propionyl]-hexahydro-s-triazine described in Japanese Patent O.P.I. Publication No. 24435/1974; the alkyl compounds described in Japanese Patent Examined Publication No. 35807/1975 and Japanese Patent O.P.I. Publication No. 44164/1976; and the compounds described in Japanese Patent O.P.I. Publication No. 18944/1984.

These vinylsulfone type hardeners are dissolved in water or an organic solvent, and added in an amount of 0.005 to 20% by weight, preferably 0.02 to 10% by weight of gelatin.

Either a batch method or an in-line method may be employed for the addition of the hardener to photographic component layers.

There is no restriction to the layers to which the hardener is added, and it may be added to the uppermost layer, the lowest layer or all layers.

The silver halide grains contained in the silver halide light-sensitive material of the present invention is of silver halide containing silver iodide including silver chloroiodide, silver bromoiodide and silver bromochloroiodide. Of them, silver bromoiodide is especially preferable since it can provide higher sensitivity.

The average silver iodide content of the silver halide grains used in the invention is 0.5 to 10 mol %, preferably 1 to 8 mol %, and the grains have preferably the sites where silver iodide of a concentration not lower than 20 mol % is localized.

In the above case, the localized sites exist preferably as far away from the outer surface of a grain as possible, and more preferably in the inside more than 0.01 μm away from the outer surface.

The localized sites may be present in the form of a layer, or in the core of a core/shell structure in which the core consists of silver iodide, wherein the core contains preferably 20 mol % or more of silver iodide.

The silver iodide content in the localized sites is preferably 30 to 40 mol %.

The outside of the localized sites is normally covered with silver halide which does not contain silver iodide. In one preferred embodiment, the shell portion present in the inside 0.01 μm or more, preferably 0.01 to 1.5 m away from the outer surface consists of a silver halide which does not contain silver iodide (typically, silver bromide).

Seed crystals may be or may not be used for forming the localized sites having a silver iodide content of at least 20 mol % preferably in the inside 0.01 μm or more away from the outer surface.

In the light-sensitive material of the present invention, at least 50% of silver halide grains contained in the emulsion layers have preferably the above localized sites.

There may be used a monodispersed silver halide emulsion containing silver halide grains having the localized sites.

The monodispersed emulsion used herein means an emulsion in which at least 95% of silver halide grains have grain sizes falling within the range of ±40%, preferably ±30% by grain number or weight of the average grain size which is measured by a normal method.

The silver halide grains used in the present invention can be prepared by the neutral method, the acid method, the ammonia method, the single-jet method, the reverse-jet method, the double-jet method, the controlled double-jet method, the conversion method and the core/shell method.

Photographic additive usable in the light-sensitive material of the present invention include a chemical sensitizer, a development accelerator, an antifogging agent, an image stabilizer, an antistain agent, UV absorbent and a hardening agent.

In the present invention, a dye may be added to a layer adjacent to a support in order to suppress the so-called cross-over effect to a minimum level. Further, a dye may be added to a protective layer and/or an emulsion layer in order to improve the sharpness of an image or suppress fogging caused by safety light. The conventional dyes can be used for the above purposes.

The support used in the present invention includes any of conventional supports. The examples thereof include a polyester film such as a film of polyethylene terephthalate, a polyamide film, a polycarbonate film, a styrene film, a baryta paper and a paper coated with a polymer. In the present invention, the emulsions are coated on one side or the both sides of a support. When the both sides of the support are coated with the emulsions, the arrangement of the emulsion layers may be either symmetrical or asymmetrical with respect to the support.

the present invention can be applied to any type of light-sensitive materials, but is especially suited to a high sensitive light-sensitive material for a monochrome or a color negative. When the present invention is applied to X-ray radiograph for medical use, it is preferred that a fluorescent sensitizing paper containing mainly a fluorescent substance which can emit near ultraviolet ray or visible ray by exposure to a transmittable radioactive ray is brought into close contact with the both sides of the light-sensitive material coated with the emulsions of the invention on the both sides of a support, followed by exposure to light.

The transmittable radioactive ray used herein means high energy electromagnetic waves, specifically X ray and $\gamma$ ray. The fluorescent sensitizing paper includes a fluorescent sensitizing paper containing calcium tungstate ($CaWO_4$) and one containing a rare earth compound activated with terbium, as a main fluorescent substance.

The light-sensitive material of the present invention is subjected to development by conventional methods. The developing solution for a monochrome contains singly or in combination the conventional developing agents such as hydroquinone, 1-phenyl-3-pyrazolidone, N-methyl-p-aminophenol and p-phenylenediamine. The other additives may be conventional ones. When the light-sensitive material of the present invention is used for color photograph, it is subjected to color development by known color development methods.

There may also be used for the light-sensitive material of the present invention, a developer containing an aldehyde hardener such as maleic dialdehyde, glutaric aldehyde, and sodium bisulfite salts thereof.

The present invention will be described in more detail with reference to the following Examples.

EXAMPLES

Example 1

A monodispersed emulsion A consisting of cubic silver halide grains having a silver iodide content of 2 mol % and an average grain diameter of 0.3 $\mu$m was prepared by the double-jet method, while controlling temperature, pAg and pH at 60° C., 8 and 2.0, respectively. The electronography thereof revealed the generation of a twin crystal was not more than 1% by number. This emulsion A was used as a seed crystal for further growing the grains as follows;

The emulsion A was dispersed at 40° C. in 8.5 of a solution which contained protective gelatin and if necessary, ammonia, and pH was adjusted by acetic acid (Process 0). An aqueous 3.2N ammonical silver ion solution and an aqueous silver halides solution were added to the above solution by the double-jet method. The values of pH and pAg were varied depending on a silver iodide content and a crystal habit.

While controlling pAg and pH at 7.3 and 9.7, respectively, a layer containing 35 mol % of silver iodide was formed. Then, while changing pH from 9 to 8 and maintaining pAg at 9.0, the grains were grown to 95% of the prescribed grain size (Process 1). A potassium bromide solution was then added by means of a nozzle for 8 minutes to change pAg to 11.0. Precipitation was ended three minutes after the completion of adding potassium bromide (Process 2). This emulsion had an average grain size of 0.55 $\mu$m and an average silver iodide content of about 2.2 mol %.

Next, the emulsion was subjected to desalting to remove excessive soluble salts.

While maintaining the emulsion at 40° C., 5 g of Compound I per mol of AgX and 8 g of $MgSO_4$ per mol of AgX were added, stirred for 5 minutes, and then allowed to stand. A supernatant was removed, and the amount of the solution was adjusted to 200 m£ per mol of AgX. Subsequently, 1.8 £ per mol of AgX of pure water of 40° C. was added, and stirred for 5 minutes (Process 3). 20 g of $MgSO_4$ per mol of AgX was added, and desalting was carried out in the same manner as mentioned above. Gelatin was added stirring to the solution to disperse AgX again.

The emulsion was chemically sensitized by the following method:

The emulsion was maintained at 55° C., and was subjected to gold/sulfur sensitization by adding ammonium thiocyanate, chloroauric acid and sodium thiosulfate. After the completion of sensitization, 4-hydroxy-6-methyl-1,3,3a,7-tetrazaindene was added (Process 4).

At the end of each of the above processes, a sensitizing dye was added to prepare the samples listed in Table 1. The timing of addition, the kind and the amount of a sensitizer are shown in Table 1.

There were added to these emulsions as additives, 400 mg of t-butyl-catechol, 1.0 g of polyvinylpyrrolidone (molecular weight: 10,000), 2.5 g of a styrene-maleic anhydride copolymer, 10 g of trimethylolpropane, 5 g of diethylene glycol, 50 mg of nitrophenyl-triphenylphosphonium chloride, 4 g of 1,3-dihydroxybenzene-4-ammonium sulfonate, 15 mg of 2-mercaptobenzimidazole-5-sodium sulfonate, 70 mg of

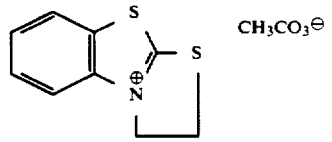

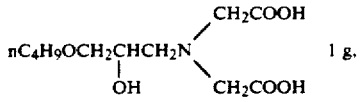

and 10 mg of 1,1-dimethylol-1-bromo-1-nitromethane, each per mol of AgX, to prepare the emulsions for coating.

As the additives for a protective layer, the following compounds were added (the amount per g of gelatin):

10 mg of

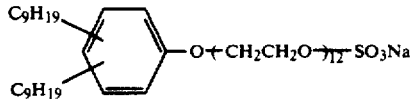

2 mg of

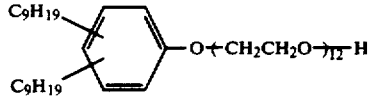

7 mg of

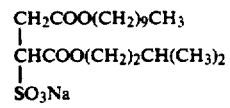

15 mg of

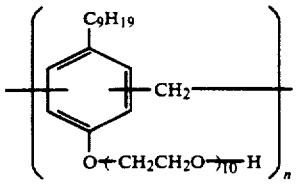

-continued (a mixture corresponding to n ranging from 2 to 5), 7 mg of a matting agent consisting of polymethylmethacrylate with an average diameter of 5 μm, 70 mg of colloidal silica with an average diameter of 0.013 μm, 8 mg of $(CHO)_2$, and 6 mg of HCHO, to prepare a coating solution for a protective layer.

To this coating solution for the protective layer, the compounds represented by Formula A and comparative compounds were added as indicated in Table 1.

Each of the coating solutions was coated on a support of a polyethylene terephthalate film which was undercoated with a 10 wt % aqueous dispersion of a copolymer consisting of 50 wt % of glycidyl methacrylate, 10 wt % of methylacrylate, and 40 wt % of butyl methacrylate.

A silver halide emulsion and a coating solution for the protective layer were simultaneously coated in this order on the both sides of the support, and dried to prepare the samples.

In each sample, the total amount of silver coated on the both sides of the support was 5 g/m². The total amount of gelatin contained in the emulsion and protective layers on the both sides of the support was 6.5 g/m². The compounds used in Example 1

Compound 1

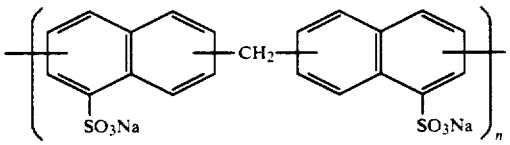

(n = 2.2)

Comparative Compounds

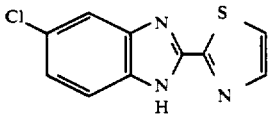

a

-continued

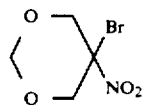

b

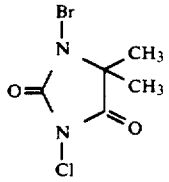

c

Each of the samples was divided into two pieces; one was stored at 23° C. and RH55% and the other at 30° C. and RH65%, respectively, for three days. A surface specific resistance and a sensitometry of each sample were measured by the following methods.

Surface Specific Resistance

A sample piece was put between a pair of brazen electrodes (interval: 0.14 cm, length: 10 cm), and subjected to measurement with a resistance meter (model: TR8651, manufactured by Takeda Riken Kogyo) for 1 minute. Before measurement, each test piece was allowed to stand for 2 hours at 25° C. and RH20%. The results are shown in Table 1.

Sensitometry

A sample was exposed in 0.1 second by standard light B described in "Databook of Illumination, new edition" as a light source without filter so that the both sides of the sample had the same exposure of 3.2 cd.m.s. The exposed sample was developed in a developer XD-SR for 45 seconds with an automatic developing machine SRX-501 (manufactured by Konica), and a sensitivity was measured. The sensitivity is defined by a reciprocal of an exposure necessary for increasing a black density by 1.0. The sensitivities shown in Table 1 are the values relative to that of Sample 1-4 in Samples 1-1 to 1-13, that of Sample 1-16 in Samples 1-14 to 1-23, and that of Sample 26 in Samples 1-24 to 1-33, each of which is set at 100.

TABLE 1

| Sample No. | Kind | Timing of addition (Process No.) | Amount*1 added | Sensitizing dye Compound of Formula A Compound No. | Amount*2 added | Surface specific resistance (Ωm) 20° CRH55% | 30° CRH65% | Sensitivity |
|---|---|---|---|---|---|---|---|---|
| 1-1 Comparison) | 1-27 + 1-26 | 0 | 300 + 3 | — | — | $9 \times 10^{11}$ | $200 \times 0\ 10^{11}$ | 120 |
| 1-2 (Comparison) | " | 1 | " | — | — | $10 \times 10^{11}$ | $200 \times 10^{11}$ | 130 |
| 1-3 (Comparison) | " | 2 | " | — | — | $15 \times 10^{11}$ | $150 \times 10^{11}$ | 130 |
| 1-4 (Comparison) | " | 3 | " | — | — | $8 \times 10^{11}$ | $75 \times 10^{11}$ | 100 |
| 1-5 (Comparison) | " | 0 | " | 57 | 1.0 | $8 \times 10^{11}$ | $65 \times 10^{11}$ | 120 |
| 1-6 (Invention) | " | 1 | " | " | " | $7 \times 10^{11}$ | $35 \times 10^{11}$ | 130 |
| 1-7 (Invention) | " | 2 | " | " | " | $7.5 \times 10^{11}$ | $20 \times 10^{11}$ | 130 |
| 1-8 (Invention) | " | 3 | " | " | " | $6 \times 10^{11}$ | $60 \times 10^{11}$ | 100 |
| 1-9 (Invention) | " | 2 | " | 47 | 1.15 | $6.5 \times 10^{11}$ | $45 \times 10^{11}$ | 135 |
| 1-10 | " | " | " | 59 | 0.86 | $7 \times 10^{11}$ | $35 \times 10^{11}$ | 130 |

TABLE 1-continued

| Sample No. | Kind | Timing of addition (Process No.) | Amount*1 added | Sensitizing dye Compound of Formula A Compound No. | Amount*2 added | Surface specific resistance (Ωm) 20° CRH55% | 30° CRH65% | Sensitivity |
|---|---|---|---|---|---|---|---|---|
| (Invention) 1-11 | " | " | " | Comparative compound-a | 1.52 | $8 \times 10^{11}$ | $80 \times 10^{11}$ | 125 |
| (Comparison) 1-12 | " | " | " | Comparative compound-b | 0.86 | $7.5 \times 10^{11}$ | $70 \times 10^{11}$ | 130 |
| (Comparison) 1-13 | KI 1-27 + 1-26 | 3*3 | 150 + 300 + 3 | — | — | $5.5 \times 10^{11}$ | $40 \times 10^{11}$ | 110 |
| (Comparison) 1-14 | 1-10 | 1 | 100 | — | — | $15 \times 10^{11}$ | $250 \times 10^{11}$ | 135 |
| (Comparison) 1-15 | " | 2 | " | — | — | $20 \times 10^{11}$ | $300 \times 10^{11}$ | 135 |
| (Comparison) 1-16 | " | 3 | " | — | — | $9 \times 10^{11}$ | $65 \times 10^{11}$ | 100 |
| (Comparison) 1-17 | " | 1 | " | 47 | 1.15 | $12 \times 10^{11}$ | $30 \times 10^{11}$ | 140 |
| (Invention) 1-18 | " | 2 | " | " | " | $15 \times 10^{11}$ | $25 \times 10^{11}$ | 135 |
| (Invention) 1-19 | " | 3 | " | " | " | $10 \times 10^{11}$ | $80 \times 10^{11}$ | 100 |
| (Invention) 1-20 | " | 2 | " | 57 | 1.0 | $10 \times 10^{11}$ | $20 \times 10^{11}$ | 135 |
| (Invention) 1-21 | " | 2 | " | 59 | 0.86 | $9 \times 10^{11}$ | $35 \times 10^{11}$ | 140 |
| (Invention) 1-22 | " | 2 | " | Comparative compound-a | 1.52 | $15 \times 10^{11}$ | $90 \times 10^{11}$ | 135 |
| (Comparison) 1-23 | " | 2 | " | Comparative compound-c | 1.10 | $20 \times 10^{11}$ | $110 \times 10^{11}$ | 130 |
| (Comparison) 1-24 | 1-3 | 1 | 70 | — | — | $15 \times 10^{11}$ | $200 + 10^{11}$ | 125 |
| (Comparison) 1-25 | " | 2 | " | — | — | $20 \times 10^{11}$ | $250 \times 10^{11}$ | 125 |
| (Comparison) 1-26 | " | 3 | " | — | — | $9 \times 10^{11}$ | $70 \times 10^{11}$ | 100 |
| (Comparison) 1-27 | " | 1 | " | 59 | 0.86 | $10 \times 10^{11}$ | $30 \times 10^{11}$ | 125 |
| (Invention) 1-28 | " | 2 | " | " | " | $10 \times 10^{11}$ | $40 \times 10^{11}$ | 125 |
| (Invention) 1-29 | " | 3 | " | " | " | $7 \times 10^{11}$ | $65 \times 10^{11}$ | 100 |
| (Invention) 1-30 | " | 2 | " | 47 | 1.15 | $6 \times 10^{11}$ | $20 \times 10^{11}$ | 125 |
| (Invention) 1-31 | " | 2 | " | 57 | 1.0 | $8.5 \times 10^{11}$ | $25 \times 10^{11}$ | 125 |
| (Invention) 1-32 | " | 2 | " | Comparative compound-a | 1.52 | $9 \times 10^{11}$ | $80 \times 10^{11}$ | 120 |
| (Comparison) 1-33 (Comparison) | " | 2 | " | Comparative compound-b | 0.86 | $9.5 \times 10^{11}$ | $95 \times 10^{11}$ | 120 |

(NOTE)
*1The amount (mg) per mol of AgX
*2The amount (mg) per g of gelatin in the protective layer
*3KI was added prior to the addition of a sensitizing dye.

Example 2

There were dissolved in 1 £ of water, potassium bromide, thioether: $HO(CH_2)_2S(CH_2)_2S(CH_2)_2S(CH_2)_2OH$, and gelatin and maintained at 65° C. (Process 0). To this solution, a silver nitrate solution and a mixed solution of potassium iodide and potassium bromide were added by the double-jet method. A point at which 50% of silver nitrate solution is added is defined as Process 1, and a point at which the addition is completed is defined as Process 2. After the completion of addition, the temperature was lowered to 40° C. Compound 1 and $MgSO_4$ were added in a amount of 2.4 g and 6 g per mol of AgX respectively, for flocculation at lowered pH to remove soluble salts by decantation. Subsequently, this solution was dispersed (Process 3), followed by the addition of gelatin.

The silver halide grains obtained were tabular and had an average diameter of 1.18 μm, a thickness of 0.15 μm, and a silver iodide content of 2.5 mol %. The emulsion was chemically sensitized in the same manner as in Example 1. The process after the chemical sensitization is defined as Process 4.

At the end of each of the above Processes 0 to 4, a sensitizing dye was added at the timing of addition and with the kinds and amount of dyes as shown in Table 2.

The compound represented by Formula A was added to the protective layer as in Example 1.

The surface specific resistance and sensitometry was measured in the same manner as in Example 1. The results are shown in Table 2.

TABLE 2

| Sample | Sensitizing dye Kind | Timing of addition (Process No.) | Amount*1 added | Compound of Formula A Compound No. | Amount*2 added | Surface specific resistance (Ωm) 20° CRH55% | 30° CRH65% | Sensitivity |
|---|---|---|---|---|---|---|---|---|
| 2-1 (Comparison) | 1-27 + 1-26 | 1 | 550 + 5 | — | — | $20 \times 10^{10}$ | $250 \times 10^{11}$ | 135 |
| 2-2 (Comparison) | " | 2 | " | — | — | $25 \times 10^{11}$ | $300 \times 10^{11}$ | 140 |
| 2-3 (Comparison) | " | 3 | " | — | — | $20 \times 10^{11}$ | $250 \times 10^{11}$ | 140 |
| 2-4 (Comparison) | " | 4 | " | — | — | $25 \times 10^{11}$ | $80 \times 10^{11}$ | 100 |
| 2-5 (Invention) | " | 1 | " | 4.7 | 1.15 | $10 \times 10^{11}$ | $35 \times 10^{11}$ | 130 |
| 2-6 (Invention) | " | 2 | " | " | " | $15 \times 10^{11}$ | $30 \times 10^{11}$ | 140 |
| 2-7 (Invention) | " | 3 | " | " | " | $10 \times 10^{11}$ | $25 \times 10^{11}$ | 140 |
| 2-8 (Comparison) | " | 4 | " | " | " | $9.5 \times 10$ | $60 \times 10^{11}$ | 140 |
| 2-9 (Invention) | " | 3 | " | 57 | 1.0 | $20 \times 10^{11}$ | $35 \times 10^{11}$ | 140 |
| 2-10 (Invention) | " | 3 | " | 59 | 0.86 | $25 \times 10^{11}$ | $40 \times 10^{11}$ | 135 |
| 2-11 (Comparison) | " | 3 | " | Comparative compound-a | 1.52 | $15 \times 10^{11}$ | $80 \times 10^{11}$ | 135 |
| 2-12 (Comparison) | 1-10 | 2 | 300 | — | — | $15 \times 10^{11}$ | $300 \times 10^{11}$ | 125 |
| 2-13 (Comparison) | " | 3 | " | — | — | $20 \times 10^{11}$ | $250 \times 10^{11}$ | 125 |
| 2-14 (Comparison) | " | 4 | " | — | — | $15 \times 10^{11}$ | $90 \times 10^{11}$ | 100 |
| 2-15 (Invention) | " | 2 | " | 57 | 1.0 | $12 \times 10^{11}$ | $35 \times 10^{11}$ | 125 |
| 2-16 (Invention) | " | 3 | " | " | " | $10 \times 10^{11}$ | $30 \times 10^{11}$ | 125 |
| 2-17 (Comparison) | " | 4 | " | " | " | $15 \times 10^{11}$ | $85 \times 10^{11}$ | 100 |
| 2-18 (Invention) | " | 2 | " | 47 | 1.15 | $10 \times 10^{11}$ | $25 \times 10^{11}$ | 125 |
| 2-19 (Invention) | " | 2 | " | 59 | 0.86 | $9 \times 10^{11}$ | $20 \times 10^{11}$ | 120 |
| 2-20 (Comparison) | " | 2 | " | Comparative compound-b | 0.86 | $15 \times 10^{11}$ | $90 \times 10^{11}$ | 125 |
| 2-21 (Comparison) | 1-3 | 2 | 250 | — | — | $9 \times 10^{11}$ | $150 \times 10^{11}$ | 130 |
| 2-22 (Comparison) | " | 3 | " | — | — | $8 \times 10^{11}$ | $100 \times 10^{11}$ | 130 |
| 2-23 (Comparison) | " | 4 | " | — | — | $8.5 \times 10^{11}$ | $90 \times 10^{11}$ | 100 |
| 2-24 (Invention) | " | 2 | " | 59 | 0.86 | $10 \times 10^{11}$ | $30 \times 10^{11}$ | 135 |
| 2-25 (Invention) | " | 3 | " | " | " | $9 \times 10^{11}$ | $35 \times 10^{11}$ | 130 |
| 2-26 (Comparison) | " | 4 | " | " | " | $9.5 \times 10^{11}$ | $85 \times 10^{11}$ | 100 |
| 2-27 (Invention) | " | 2 | " | 47 | 1.15 | $15 \times 10^{11}$ | $35 \times 10^{11}$ | 135 |
| 2-28 (Invention) | " | 3 | " | 57 | 1.0 | $12 \times 10^{11}$ | $25 \times 10^{11}$ | 130 |
| 2-29 (Comparison) | " | 3 | " | Comparative compound-c | 1.10 | $10 \times 10^{11}$ | $95 \times 10^{11}$ | 125 |
| 2-30 (Comparison) | 1-27 + 1-26 | 0 | 550 + 5 | — | — | $25 \times 10^{11}$ | $300 \times 10^{11}$ | 130 |
| 2-31 (Comparison) | " | 0 | " | 47 | 1.15 | $25 \times 10^{11}$ | $150 \times 10^{11}$ | 130 |
| 2-32 (Comparison) | " | 4 | " | 57 | 1.0 | $15 \times 10^{11}$ | $85 \times 10^{11}$ | 100 |
| 2-33 (Comparison) | " | 4 | " | 59 | 0.86 | $10 \times 10^{11}$ | $75 \times 10^{11}$ | 100 |

(NOTE)
*1The amount (mg) per mol of AgX
*2The amount (mg) per g of gelatin in the protective layer As in understood from the results shown in Tables 1 and 2, when a sensitizing dye in added after chemical ripening (Process 4) which is out of the invention, an antistatic property cannot be improved under the circumstance of high humidity, even though the compound represented by Formula A is added. On the other hand, the samples which are spectrally sensitized by the method of the present invention have an enhanced sensitivity and a surface specific resistance significantly lowered at a high humidity, thus exhibiting an excellent antistatic property.

The samples were then subjected to the static mark test in which an unexposed sample placed on a rubber sheet was pressed with a rubber roller, followed by stripping. The results reveal that no static marks are formed on the samples of the present invention. The results of the static mark test are well in harmony with the results of the measurement of the surface specific resistance.

Example 3

Samples 3-1 to 3-70 were prepared in the same manner as in Examples 1 and 2 besides that $(CHO)_2$ and HCHO in Samples 1-5 to 1-10, 1-18, 1-25, 2-5 and 2-6 were replaced with the compounds shown in Table 3.

Each of the above samples was divided into two pieces; one was stored at 55° C. and RH55% and the other at 23° C. and RH55%, respectively, for three days. The samples were subjected to measurement of sensitometry in the same manner as in Example 1. In Table 3, the sensitivity at 55° C. and RH55% is the value relative to that at 23° C. and RH55%, which is set at 100.

TABLE 3

| Sample No. | Corresponding Sample No. | Compound added | Amount added | Sensitivity (55° C., RH55%, 3 days) | Remarks |
|---|---|---|---|---|---|
| 3-1 (Comparison) | 1-5 | HCHO | 6 mg | 140 | Same as |
| | | $(CHO)_2$ | 8 mg | | Sample 1-5 |
| 3-2 (Comparison) | 1-5 | V-2 | 70 mg | 130 | |
| 3-3 (Comparison) | 1-5 | V-4 | 75 mg | 125 | |
| 3-4 (Comparison) | 1-5 | V-6 | 80 mg | 130 | |
| 3-5 (Comparison) | 1-5 | V-9 | 110 mg | 135 | |
| 3-6 (Comparison) | 1-5 | V-10 | 115 mg | 130 | |
| 3-7 (Comparison) | 1-5 | V-12 | 160 mg | 125 | |
| 3-8 (Comparison) | 1-5 | V-22 | 145 mg | 125 | |
| 3-9 (Invention) | 1-6 | HCHO | 6 mg | 120 | Same as |
| | | $(CHO)_2$ | 8 mg | | Sample 1-6 |
| 3-10 (Invention) | 1-6 | V-2 | 70 mg | 105 | |
| 3-11 (Invention) | 1-6 | V-4 | 75 mg | 102 | |
| 3-12 (Invention) | 1-6 | V-6 | 80 mg | 105 | |
| 3-13 (Invention) | 1-6 | V-9 | 110 mg | 110 | |
| 3-14 (Invention) | 1-6 | V-10 | 115 mg | 105 | |
| 3-15 (Invention) | 1-6 | V-12 | 160 mg | 105 | |
| 3-16 (Invention) | 1-6 | V-22 | 145 mg | 102 | |
| 3-17 (Invention) | 1-7 | HCHO | 6 mg | 120 | Same as |
| | | $(CHO)_2$ | 8 mg | | Sample 1-7 |
| 3-18 (Invention) | 1-7 | V-2 | 70 mg | 102 | |
| 3-19 (Invention) | 1-7 | V-4 | 75 mg | 100 | |
| 3-20 (Invention) | 1-7 | V-6 | 80 mg | 105 | |
| 3-21 (Invention) | 1-7 | V-9 | 110 mg | 105 | |
| 3-22 (Invention) | 1-7 | V-10 | 115 mg | 102 | |
| 3-23 (Invention) | 1-7 | V-12 | 160 mg | 105 | |
| 3-24 (Comparison) | 1-8 | HCHO | 6 mg | 150 | Same as |
| | | $(CHO)_2$ | 8 mg | | Sample 1-8 |
| 3-25 (Comparison) | 1-8 | V-2 | 70 mg | 130 | |
| 3-26 (Comparison) | 1-8 | V-4 | 75 mg | 125 | |
| 3-27 (Comparison) | 1-8 | V-6 | 80 mg | 125 | |
| 3-28 (Comparison) | 1-8 | V-9 | 110 mg | 130 | |
| 3-29 (Comparison) | 1-8 | V-10 | 115 mg | 140 | |
| 3-30 (Comparison) | 1-8 | V-12 | 160 mg | 135 | |
| 3-31 (Comparison) | 1-8 | V-22 | 145 mg | 125 | |
| 3-32 (Invention) | 1-7 | V-22 | 145 mg | 105 | |
| 3-33 (Invention) | 1-9 | HCHO | 6 mg | 115 | Same as |
| | | $(CHO)_2$ | 8 mg | | Sample 1-9 |
| 3-34 (Invention) | 1-9 | V-2 | 70 mg | 100 | |
| 3-35 (Invention) | 1-9 | V-4 | 75 mg | 100 | |
| 3-36 (Invention) | 1-9 | V-6 | 80 mg | 105 | |
| 3-37 (Invention) | 1-9 | V-9 | 110 mg | 105 | |
| 3-38 (Invention) | 1-9 | V-12 | 160 mg | 102 | |
| 3-39 (Invention) | 1-9 | V-22 | 145 mg | 110 | |
| 3-40 (Invention) | 1-10 | HCHO | 6 mg | 120 | Same as |
| | | $(CHO)_2$ | 8 mg | | Sample 1-10 |
| 3-41 (Invention) | 1-10 | V-2 | 70 mg | 102 | |
| 3-42 (Invention) | 1-10 | V-4 | 75 mg | 100 | |
| 3-43 (Invention) | 1-10 | V-6 | 80 mg | 105 | |
| 3-44 (Invention) | 1-10 | V-9 | 110 mg | 105 | |
| 3-45 (Invention) | 1-18 | HCHO | 6 mg | 115 | Same as |
| | | $(CHO)_2$ | 8 mg | | Sample 1-18 |
| 3-46 (Invention) | 1-18 | V-2 | 70 mg | 105 | |
| 3-47 (Invention) | 1-18 | V-4 | 75 mg | 102 | |
| 3-48 (Invention) | 1-18 | V-6 | 80 mg | 110 | |
| 3-49 (Invention) | 1-18 | V-9 | 110 mg | 110 | |
| 3-50 (Invention) | 1-25 | HCHO | 6 mg | 120 | Same as |
| | | $(CHO)_2$ | 8 mg | | Sample 1-25 |
| 3-51 (Invention) | 1-25 | V-2 | 70 mg | 110 | |
| 3-52 (Invention) | 1-25 | V-4 | 75 mg | 105 | Same as |
| 3-53 (Invention) | 1-25 | V-6 | 80 mg | 110 | Sample 1-25 |
| 3-54 (Invention) | 1-25 | V-9 | 110 mg | 110 | |
| 3-55 (Invention) | 2-5 | HCHO | 6 mg | 115 | Same as |
| | | $(CHO)_2$ | 8 mg | | Sample 2-5 |

TABLE 3-continued

| Sample No. | Corresponding Sample No. | Compound added | Amount added | Sensitivity (55° C., RH55%, 3 days) | Remarks |
|---|---|---|---|---|---|
| 3-56 (Invention) | 2-5 | V-2 | 70 mg | 105 | |
| 3-57 (Invention) | 2-5 | V-4 | 75 mg | 100 | |
| 3-58 (Invention) | 2-5 | V-6 | 80 mg | 100 | |
| 3-59 (Invention) | 2-5 | V-9 | 110 mg | 102 | |
| 3-60 (Invention) | 2-5 | V-10 | 115 mg | 110 | |
| 3-61 (Invention) | 2-5 | V-12 | 160 mg | 105 | |
| 3-62 (Invention) | 2-5 | V-22 | 145 mg | 105 | |
| 3-63 (Invention) | 2-6 | HCHO | 6 mg | 120 | Same as |
| | | $(CHO)_2$ | 8 mg | | Sample 2-6 |
| 3-64 (Invention) | 2-6 | V-2 | 70 mg | 105 | |
| 3-65 (Invention) | 2-6 | V-4 | 75 mg | 102 | |
| 3-66 (Invention) | 2-6 | V-6 | 80 mg | 110 | |
| 3-67 (Invention) | 2-6 | V-9 | 110 mg | 105 | |
| 3-68 (Invention) | 2-6 | V-12 | 160 mg | 105 | |
| 3-69 (Invention) | 2-6 | V-22 | 145 mg | 110 | |
| 3-70 (Invention) | 1-7 | V-22 | 85 mg | 105 | |
| | | Taurine K salt | 115 mg | 105 | |

As is understood from Table 3, the samples of the present invention are excellent in the preservability at higher temperatures, and a vinylsulfone type hardener rather than HCHO and $(CHO)_2$ contributes to increasing this effect.

The effect of the present invention could also be observed when VS-11, 13, 25, 28, 29, 32, 33, 38, 40, 53, 54, 55 and 56 are used.

Example 4

There was stirred at 40° C. the solution containing 130 g of KBr, 2.5 g of KI, 30 mg of 1-phenyl-5-mercaptotetrazole and 15 of gelatin (Process 0).

To this solution, 500 ml of the solution containing 0.5 mol of ammonical silver nitrate were added for one minute, and acetic acid was added to adjust pH to 6.0 two minutes later the completion of addition (Process 1). Further one minute later, 500 ml of the solution containing 0.5 mol of silver nitrate was added for one minute, and the emulsion was stirred for 15 minutes (Process 2).

Next, the condensation product of sodium naphthalenesulfonate and formalin and an aqueous solution of magnesium sulfate were added to the emulsion for flocculation. After decantation, water of 40° C. was added, followed by stirring for 10 minutes. Then, the magnesium sulfate solution was added again for recoagulation. After decantation, 300 ml of a 5% gelatin solution was added, followed by stirring for 30 minutes to prepare the emulsion (Process 3). The emulsion was left for cooling. This emulsion contained silver halide grains having an average grain size of 0.40 μm, and 90% of the whole grains fell within the range of 0.20 to 0.70 μm.

The emulsion was subjected to chemical sensitization at 52° C. with 20.0 mg of ammonium thiocyanate, 5.0 mg of chloroauric acid and 15.0 mg of sodium thiosulfate, each amount per mol of silver halide (Process 4: 10 minutes before the completion of chemical sensitization). 4-hydroxy-6-methyl-1,3,3a,7-tetrazaindene was added 100 minutes later the addition of a sensitizer (Process 5).

There was provided a backcoat layer on a polyethylene terephthalate film support by coating the solution consisting of 400 g of gelatin, 2 g of polymethyl methacrylate, 6 g of sodium dodecylbenzenesulfonate, 20 g of the following antihalation agent, N,N'-ethylene-bis-(vinylsulfonylacetoamide), and polyethylenesodium sulfonate, and then was provided a subbing layer by coating the 10 wt % aqueous dispersion of a copolymer consisting of glycidyl methacrylate 50 wt %, methyl acrylate 10 wt % and butyl methacrylate 40 wt %. There was further provided a protective layer on one side of the subbed support by coating the solution containing gelatin, a matting agent (polymethyl methacrylate: average grain size 3.5 μm), glyoxal, sodium t-octylphenoxy-ethoxyethanesulfonate,

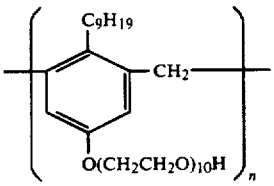

$.C_8F_{17}SO_2N(C_3H_7)CH_2COOK$
$.C_8F_{17}SO_2N(C_3H_7)(CH_2CH_2O)_{16}H$ (mixture corresponding to n of 2 to 5)

The amounts of gelatin coated on the subbing and protective layers were 2.5 and 2.0 g/m$^2$, respectively.

Antihalation agent

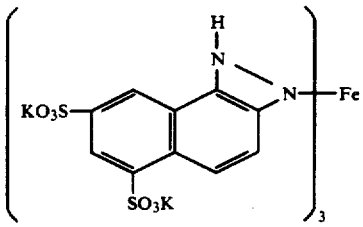

The Coating Emulsion

The following compounds were added in an amount per mol of AgX to the previously prepared emulsion in order to prepare a coating emulsion:

| | |
|---|---|
| Trimethylol propane | 10 g |
| Nitrophenyl-triphenylphosphonium chloride | 50 mg |
| Ammonium 1,3-dihydroxybenzene-4-sulfonate | 1 g |
| Sodium 2-mercaptobenimidazole-5-sulfonate | 10 mg |

-continued

| | |
|---|---|
| 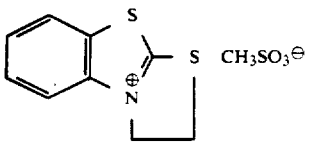 | 35 mg |
| $n\text{-}C_4H_9OCH_2CH(OH)CH_2N(CH_2COOH)_2$ | 1 g |
| 1,1-dimethylol-1-bromo-1-nitromethane | 10 mg |
| 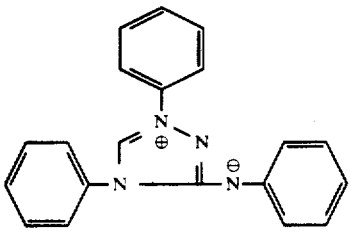 | 100 mg |

The Coating Solution For Protective Layer

The composition per liter of the coating solution:

| | |
|---|---|
| Lime-treated inert gelatin | 68 g |
| Acid-treated gelatin | 2 g |
| $NaO_3S-CH(CH_2COOC_{10}H_{21})-COOC_5H_{11}$ | 1 g |
| Polymethyl methacrylate matting agent (area average grain size: 3.5 μm) | 1.1 g |
| Silicon dioxide grain matting agent (area average grain size: 1.2 μm) | 0.5 g |
| Ludox AM made by Du Pont, colloidal silica | 30 g |
| 2,4-dichloro-6-hydroxy-1,3,5-triazine sodium salt, 2% aqueous solution | 10 ml |
| Formalin, 35% aqueous solution | 2 ml |
| Glyoxal, 40% aqueous solution | 1.5 ml |
| 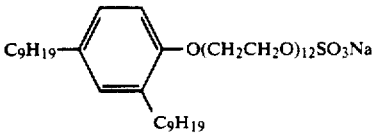 | 1.0 g |

-continued

| | |
|---|---|
| 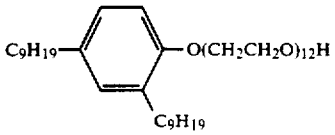 | 0.4 g |
| $CH_2COO(CH_2)_9CH_3$ / $CHCOO(CH_2)_2CH(CH_3)_2$ / $SO_3Na$ | 0.3 g |
| 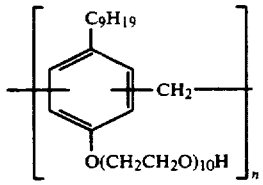 (mixture corresponding to n of 2 to 5) | 0.5 g |
| $NaO_3S-CH(CH_2COOCH_2(C_2F_4)_3H)-COOCH_2(C_2F_4)_3H$ | 0.5 g |
| $F_{19}C_9-O(CH_2CH_2O)_{10}CH_2CH_2OH$ | 3 mg |
| $C_4F_9SO_3K$ | 2 mg |

There were coated simultaneously on the subbed support, a silver halide emulsion layer and a protective layer at a coating speed of 60 m/min to prepare the samples. The amount of coated silver was 2.5 g/m$^2$, and those of gelatin coated on the emulsion and protective layers were 3.0 and 1.3 g/m$^2$, respectively.

The above samples were preserved at 23° C. and RH55% for three days to stabilize the layers. Then, they were exposed in $10^{-5}$ second per picture element (100 μm$^2$) with a semiconductor laser emitting light in 800 nm. The exposed samples were developed in the developing solution XD-SR and fixing solution XF-SR manufactured by Konica Corp for an automatic X-ray film developing machine with an automatic X-ray film developing machine SRX-501 manufactured by Konica Corp in 45 seconds.

The surface specific resistance and sensitivity of the above samples were measured in the same way as in Example 1. The sensitivity is the value relative to that of Sample 4-4 measured within one day after chemical sensitization, which is set at 100. The results are summerized in Table 4.

TABLE 4

| | Sensitizing dye | | | Compound of Formula A | | Surface specific resistance (Ωm) | | |
|---|---|---|---|---|---|---|---|---|
| Sample No. | Kind | Timing of addition (Process No.) | AMount added (mg/mol of AgX) | Compound No. | Amount*1 added | 20° CRH55% | 30+ CRH65% | Sensitivity |
| 4-1 (Comparison) | II-9 | 0 | 15 | — | — | $8 \times 10^{11}$ | $200 \times 10^{11}$ | 125 |
| 4-2 (Comparison) | " | 1 | " | — | — | $8 \times 10^{11}$ | $150 \times 10^{11}$ | 125 |
| 4-3 (Comparison) | " | 2 | " | — | — | $8.5 \times 10^{11}$ | $180 \times 10^{11}$ | 120 |
| 4-4 (Comparison) | " | 3 | " | — | — | $7 \times 10^{11}$ | $100 \times 10^{11}$ | 100 |
| 4-5 (Comparison) | " | 4 | " | — | — | $7.5 \times 10^{11}$ | $90 \times 10^{11}$ | 85 |
| 4-6 (Comparison) | " | 5 | " | — | — | $8 \times 10^{11}$ | $100 \times 10^{11}$ | 80 |
| 4-7 | " | 0 | " | 57 | 1.0 | $8 \times 10^{11}$ | $75 \times 10^{11}$ | 125 |

TABLE 4-continued

| Sample No. | Sensitizing dye Kind | Timing of addition (Process No.) | AMount added (mg/mol of AgX) | Compound of Formula A Compound No. | Amount*1 added | Surface specific resistance (Ωm) 20° CRH55% | 30+ CRH65% | Sensitivity |
|---|---|---|---|---|---|---|---|---|
| (Comparison) 4-8 | " | 1 | " | " | " | $7 \times 10^{11}$ | $35 \times 10^{11}$ | 130 |
| (Invention) 4-9 | " | 2 | " | " | " | $6 \times 10^{11}$ | $20 \times 10^{11}$ | 125 |
| (Invention) 4-10 | " | 3 | " | " | " | $8 \times 10^{11}$ | $65 \times 10^{11}$ | 100 |
| (Invention) 4-11 | " | 4 | " | " | " | $9 \times 10^{11}$ | $90 \times 10^{11}$ | 85 |
| (Comparison) 4-12 | " | 5 | " | " | " | $8.5 \times 10^{11}$ | $100 \times 10^{11}$ | 78 |
| (Comparison) 4-13 | " | 1 | " | 59 | 0.86 | $6.5 \times 10^{11}$ | $30 \times 10^{11}$ | 130 |
| (Invention) 4-14 | " | 2 | " | " | " | $6 \times 10^{11}$ | $35 \times 10^{11}$ | 125 |
| (Invention) 4-15 | " | 1 | " | 47 | 1.15 | $7.5 \times 10^{11}$ | $20 \times 10^{11}$ | 120 |
| (Invention) 4-16 | " | 2 | " | " | " | $7 \times 10^{11}$ | $25 \times 10^{11}$ | 120 |
| (Invention) 4-17 | II-20 | 0 | " | 57 | 1.0 | $4.5 \times 10^{11}$ | $75 \times 10^{11}$ | 115 |
| (Comparison) 4-18 | " | 1 | " | " | " | $5 \times 10^{11}$ | $10 \times 10^{11}$ | 110 |
| (Invention) 4-19 | " | 2 | " | " | " | $4.5 \times 10^{11}$ | $15 \times 10^{11}$ | 115 |
| (Invention) 4-20 | " | 3 | " | " | " | $6.0 \times 10^{11}$ | $65 \times 10^{11}$ | 100 |
| (Invention) 4-21 | " | 4 | " | " | " | $7.5 \times 10^{11}$ | $100 \times 10^{11}$ | 78 |
| (Comparison) 4-22 | " | 5 | " | " | " | $6.0 \times 10^{11}$ | $150 \times 10^{11}$ | 70 |
| (Comparison) | | | | | | | | |

(NOTE) *1The amount (mg) per g of gelatin in the protective layer.

It can be found from Table 4 that Samples 408, 9, 13, to 16, 18 and 19 of the invention have higher sensitivities and lower surface specific resistances in preservation at higher temperature than the comparative samples.

What is claimed is:

1. A silver halide photographic light-sensitive material having improved antistatic properties, said material comprising a support and, provided thereon, at least one silver halide light-sensitive layer containing a silver bromoiodide emulsion spectrally sensitized by adding a spectral sensitizing dye during at least one process selected from a grain formation process, a physical ripening process, and a desalting process, wherein said light-sensitive material contains at least one compound represented by the following Formula A:

A

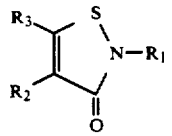

wherein $R_1$ represents a hydrogen atom, an alkyl group, a cycloalkyl group, an alkenyl group, an aralkyl group, an alkoxy group, an aryl group, a heterocyclic group, a carbamoyl group, a thiocarbamoyl group, or a sulfamoyl group; $R_2$ and $R_3$ represent independently a hydrogen atom, a halogen atom, an alkyl group, a cycloalkyl group, an aryl group, a cyano group, an alkylthio group, an arylthio group, an alkylsulfoxide group, an alkylsulfonyl group, or a heterocyclic group, provided that $R_2$ and $R_3$ may combine each other to form a benzene ring; provided that said alkyl group, cycloalky group, alkenyl group, aralkyl group, alkoxy group, aryl group, heterocyclic group, carbamoyl group, thiocarbamoyl group, and sulfamoyl group may have substituents.

2. The light-sensitive material of claim 1, wherein said compound represented by Formula A is represented by Formula A-1, unless $R_2$ and $R_3$ combine to form a benzene ring, and represented by Formula A-2, provided that $R_2$ and $R_3$ combine to form a bezene ring:

Formula A-1

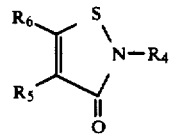

wherein $R_4$, $R_5$ and $R_6$ represent the same groups as those defined by $R_1$, $R_2$ and $R_3$ in Formula A, respectively;

Formula A-2

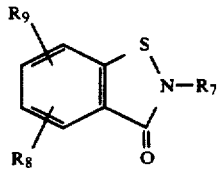

wherein $R_7$ represents the same groups as those defined by $R_1$ in Formula A; $R_8$ and $R_9$ represent independently a hydrogen atom, a halogen atom, an alkyl group having 1 to 4 carbon atoms, an alkoxy group having 1 to 4 carbon atoms, a nitro group, and a cyano group.

3. The light-sensitive material of claim 2, wherein said alkyl group and alkenyl group represented by $R_4$ have independently 1 to 36 carbon atoms.

4. The light-sensitive material of claim 3, wherein said groups have independently 1 to 18 carbon atoms.

5. The light-sensitive material of claim 2, wherein said $R_4$ is cycloalkyl group having 3 to 12 carbon atoms.

6. The light-sensitive material of claim 5, wherein said cycloalkyl group has 3 to 6 carbon atoms.

7. The light-sensitive material of claim 2, wherein said aryl group is a phenyl group which may have a substituent.

8. The light-sensitive material of claim 7, wherein said substituent is a halogen atom, a nitro group and a cyano group.

9. The light-sensitive material of claim 2, wherein the substituents for said carbamoyl group, thiocarbamoyl group and sulfamoyl group are an alkyl group having 1 to 8 carbon atoms and a phenyl group which may have a substituent.

10. The light-sensitive material of claim 9, wherein said substituent for said phenyl group is a halogen atom, a nitro group or a cyano group.

11. The light-sensitive material of claim 2, wherein said $R_4$ is a heterocyclic group which is 5- or 6-membered and contains at least one of a nitrogen atom, an oxygen atom, and a sulfur atom.

12. The light-sensitive material of claim 11, wherein said heterocyclic group is a furyl group, a thiazolyl group and a thienyl group, each of which may have a substituent.

13. The light-sensitive material of claim 12, wherein said substituient is a halogen atom or an alkyl group having 1 to 5 carbon atoms.

14. The light-sensitive material of claim 2, wherein said compound represented by Formula A-1 is added in an amount of $1\times10^{-4}$ to 10 weight % of gelatin.

15. The light-sensitive material of claim 14, wherein said amount is $3\times10^{-4}$ to 1 weight % of gelatin.

16. The light-sensitive material of claim 1, wherein said spectral sensitizing dye is a cyanine dye, a merocyanine dye, a complex cyanine dye, a complex merocyanine dye, a holopolar-cyanine dye, a hemicyanine dye, a styryl dye, or a hemioxonol dye.

17. The light-sensitive material of claim 16, wherein said spectral sensitizing dye is a cyanine dye represented by Formula I or a complex cyanine dye represented by Formula II:

Formula I

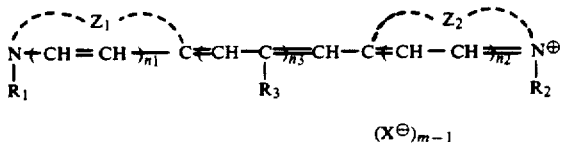

wherein $Z_1$ and $Z_2$ represent independently the group of non-metallic atoms necessary to form a pyrroline ring, a thiazoline ring, a thiazole ring, a benzothiazole ring, a naphthothiazole ring, a selenazole ring, a benzoselenazole ring, a naphthoselenazole ring, an oxazole ring, a benzoxazole ring, a naphthoxazole ring, an imidazole ring, a benzimidazole ring, and a pyridine ring, each of which may have substituents of a halogen atom, a lower alkyl group, a lower alkoxy group and a phenyl group, or a phenyl group condensed thereto; $R_1$ and $R_2$ represent independently a lower alkyl group, a hydroxyalkyl group, a carboxyalkyl group, and a sulfoalkyl group; $n_1$ and $n_2$ each represent 0 and 1, and $n_3$ represents 0, 1 or 2; m represents 1 or 2; $R_3$ represents a hydrogen atom or a lower alkyl group when $n_3$ is 1, and a hydrogen atom when $n_3$ is 2; $X^{\ominus}$ represents an anion;

Formula II

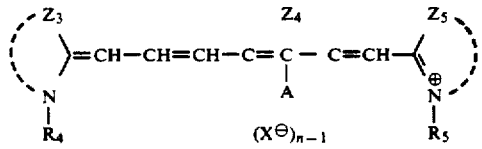

wherein $Z_3$ and $Z_5$ represent independently the group of atoms necessary to form a benzothiazole ring, a benzoxazole ring, a naphthothiazole ring, and a naphthoxazole ring, each of which may have a substituent; $R_4$ and $R_5$ represent independently a saturated or unsaturated aliphatic group; $Z_4$ represents a 5- or 6-membered hydrocarbon ring; A represents a hydrogen atom, provided that $Z_4$ forms a 6-membered ring.

18. The light-sensitive material of claim 17, wherein said substituent for the ring formed by $Z_3$ or $Z_5$ is a hydrogen atom, an alkyl group having 1 to 4 carbon atoms, or an alkoxy group having 1 to 4 carbon atoms.

19. The light-sensitive material of claim 17, wherein said spectral sensitizing dye represented by Formula II is represented by Formula II-a, provided that $Z_4$ forms a 5-membered ring:

Formula II-a

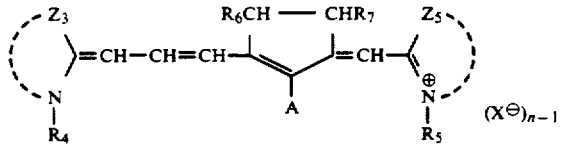

wherein A represents

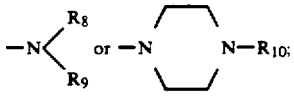

$R_6$ and $R_7$ represent independently a hydrogen atom, a halogen atom, an alkyl group having 1 to 4 carbon atoms, and an alkoxy group having 1 to 4 carbon atoms; $R_8$ and $R_9$ represent independently an alkyl group having 1 to 12 carbon atoms, an alkoxycarbonylalkyl group, and an aryl group; $R_{10}$ represents an alkyl group having 1 to 12 carbon atoms, an aryl group having 6 to 10 carbon atoms, and an alkoxycarbonyl group having an alkoxy group having 1 to 4 carbon atoms; $X^{\ominus}$ represents an anion; and n is 1 or 2, provided that n is 1 when an inner salt is formed.

20. The light-sensitive material of claim 17, wherein said spectral sensitizing dye represented by Formula II is represented by Formula II-b, provided that the ring formed by $Z_4$ is a 6-membered ring:

Formula II-b

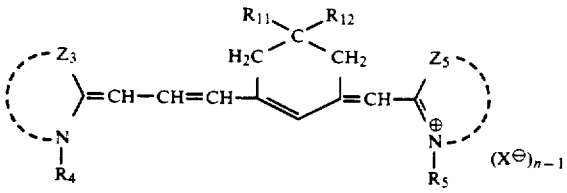

wherein $R_{11}$ represents a hydrogen atom or a methyl group; $R_{12}$ represents a hydrogen atom, an alkyl group having 1 to 4 carbon atoms, or a monocyclic aryl group; $X^{\ominus}$ represents an anion; and n is 1 or 2, provided that n is 1 when an inner salt is formed.

21. The light-sensitive material of claim 17, wherein said spectral sensitizing dye is added in an amount of 0.001 to 1 mol/mol of silver bromoiodide.

22. The light-sensitive material of claim 1, comprising hydrophilic colloid layers including at least one silver bromoiodide emulsion layer.

23. The light-sensitive material of claim 22, wherein said hydrophilic colloid layers are hardened with a vinylsulfone hardener represented by following Formula VS-1:

$$L-(SO_2-X)m$$

wherein L represents an m-valent linkage group which may have a substituent; X represents $-CH=CH_2$ or $CH_2CH_2Y$; Y represents a group capable of splitting off in the form of HY by reaction with a base; and m represents an integer of 2 to 10, provided that a plural of $-SO_2-X$ may be the same of different when m is two or more.

24. The light-sensitive material of claim 23, wherein said Y is a halogen atom, a sulfonyloxy group, a sulfoxy group, or a residue of a tertiary amine.

25. The light-sensitive material of claim 23, wherein said L is formed by combining one or more of an aliphatic hydrocarbon group, an aromatic hydrocarbon group, —O—, $-NR^1-$ in which $R^1$ represents a hydrogen atom or an alkyl group having 1 to 15 carbon atoms, —S—, —N—, —CO—, —SO—, $-SO_2-$, and $-SO_3-$, provided that $R^1$'s may be combined each other to form a ring when two or more $-NR^1-$ are contained therein.

26. The light-sensitive material of claim 23, wherein said substituent for L is a hydroxy group, an alkoxy group, a carbamoyl group, a sulfamoyl group, an alkyl group, or an aryl group.

27. The light-sensitive material of claim 2, wherein said $R_4$ is an alkyl group having a halogen atom, a hydroxyl group, an amino group, or an alkylamino group as a substituent.

28. A method of improving surface specific resistivity and antistatic properties of silver halide photographic light-sensitive materials comprising a support and provided thereon, said method comprising spectrally sensitizing at least one silver halide light-sensitive layer by adding a spectral sensitizing dye during at least one process selected from a grain formation process, a physical ripening process, and a desalting process, wherein said light-sensitive material ccontains at least one compound represented by the following Formula A:

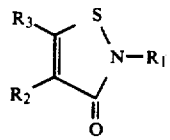

A wherein $R_1$ represents a hydrogen atom, an alkyl group, a cycloalkyl group, an alkenyl group, an aralkyl group, an alkoxy group, an aryl group, a heterocyclic group, a carbamoyl group, a thiocarbamoyl group, or a sulfamoyl group; $R_2$ and $R_3$ represent independently a hydrogen atom, a halogen atom, an alkyl group, a cycloalkyl group, an aryl group, a cyano group, an alkylthio group, an arylthio group, an alkylsulfoxide group, an alkylsulfonyl group, or a heterocyclic group, provided that $R_2$ and $R_3$ may combine each other to form a benzene ring; provided that said alkyl group, cycloalkyl group, alkenyl group, aralkyl group, alkoxy group, aryl group, heterocyclic group, carbamoyl group, thiocarbamoyl group, and sulfamoyl group may have substituents.

* * * * *